US011163258B2

(12) United States Patent
Sano et al.

(10) Patent No.: US 11,163,258 B2
(45) Date of Patent: Nov. 2, 2021

(54) IMAGE FORMING APPARATUS HAVING MOVABLE DEVELOPING ROLLER WITH BIDIRECTIONALLY-ROTATABLE CAM

(71) Applicant: BROTHER KOGYO KABUSHIKI KAISHA, Nagoya (JP)

(72) Inventors: Toshiyuki Sano, Iwakura (JP); Shintaro Sakaguchi, Nagoya (JP); Yusuke Ikegami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/111,633

(22) Filed: Dec. 4, 2020

(65) Prior Publication Data

US 2021/0200140 A1 Jul. 1, 2021

(30) Foreign Application Priority Data

Dec. 25, 2019 (JP) ..... JP2019-234143

(51) Int. Cl.
*G03G 15/00* (2006.01)
*G03G 21/16* (2006.01)
*G03G 15/01* (2006.01)

(52) U.S. Cl.
CPC ..... *G03G 21/1633* (2013.01); *G03G 15/0121* (2013.01); *G03G 21/1676* (2013.01); *G03G 2221/1609* (2013.01)

(58) Field of Classification Search
CPC ..... G03G 15/0121; G03G 15/5008; G03G 21/1633; G03G 21/1647; G03G 21/1676; G03G 21/1857; G03G 21/186; G03G 2221/1609; G03G 2221/1657
See application file for complete search history.

(56) References Cited

U.S. PATENT DOCUMENTS

2010/0104311 A1* 4/2010 Okamoto ..... G03G 15/6502 399/75
2012/0243908 A1* 9/2012 Aratachi ..... G03G 15/0806 399/167
2020/0004198 A1* 1/2020 Nakano ..... G03G 15/0121
2020/0310281 A1* 10/2020 Haruta ..... G03G 21/186
2021/0011427 A1* 1/2021 Saeki ..... G03G 21/1676

FOREIGN PATENT DOCUMENTS

JP 2009-282126 A 12/2009
JP 2012-128017 A 7/2012

* cited by examiner

*Primary Examiner* — Sophia S Chen
(74) *Attorney, Agent, or Firm* — Scully, Scott, Murphy & Presser, PC

(57) ABSTRACT

An image forming apparatus, having a casing, a cover, a photosensitive drum, a developing roller, a photo-interrupter, a moving mechanism to move the developing roller between a contacting position and a separated position, and a controller, is provided. The moving mechanism has a cam including, a first cam portion, a phase-detector wall including a first slit and a second slit, and a cam follower. When the cover moves from the open position to the closed position, the controller conducts a first initializing control to cause the cam to rotate in a reverse direction, and after detecting the first slit based on a time period, in which light in the photo-interrupter passes through one of the first slit and the second slit, cause the cam to stop rotating.

13 Claims, 26 Drawing Sheets

IMAGE FORMING APPARATUS HAVING MOVABLE DEVELOPING ROLLER WITH BIDIRECTIONALLY-ROTATABLE CAM

CROSS REFERENCE TO RELATED APPLICATION

This application claims priority from Japanese Patent Application No. 2019-234143, filed on Dec. 25, 2019, the entire subject matter of which is incorporated herein by reference.

BACKGROUND

Technical Field

An aspect of the present disclosure is related to an image forming apparatus capable of moving a developing roller to separate from a photosensitive drum.

Related Art

Image forming apparatus, having a developing roller and a photosensitive drum, capable of forming images electrophotographically, is known. In the image forming apparatus with the developing roller and the photosensitive drum, in order to restrain the developing cartridge from being exhausted in a shorter term, the developing roller may be separated from the photosensitive drum in a timely fashion.

For example, an image forming apparatus may have a rotatable disc-shaped cam to move the developing roller. In particular, the cam may rotate to move the developing roller to contact or separate from the developing roller. The cam may have a disc portion with a gear, and a cam portion arranged on the disc portion., The cam portion may move the developing roller between a position, at which the developing roller contacts the photosensitive drum, and a position, at which the developing roller is separated from the photosensitive drum. Moreover, the cam may have a flag having a form of a rib and a phase-detectable sensor to detect the flag, by which a phase of the cam at a home position may be detected. With this arrangement, when the phase-detectable sensor detects the flag, it may be determined that the developing roller is in a separated condition, in which the developing roller is separated from the photosensitive drum.

For another example, an image forming apparatus may have a rotatable cam, with a leaf cam portion on one side thereof and a cylindrical wall portion projecting on the other side thereof. The cylindrical wall portion may have, for example, three (3) slits. The slits may have different sizes, based on which a controller may detect different phases of the rotating cam. The controller may, during an initializing action after, for example, the image forming apparatus is powered on, identify one of the slits passing by a sensor based on the size and control the cam to stop when a next one of the slits comes in the position to be detected by the sensor.

SUMMARY

The former one of the image forming apparatuses mentioned above may have solely one (1) flag in the cam, by which one of the plurality of phases of the cam, corresponding to the separated condition of the developing roller, may be detected. Depending on the single flag alone, when attempting to stop the rotating cam while the developing roller is in another condition, in which the developing roller contacts the photosensitive drum, the phase of the cam may not be accurately detected.

Meanwhile, the latter one of the image forming apparatuses mentioned above with three different-sized slits may detect both the separated condition, in which the developing roller is separated from the photosensitive drum, and a contacting condition, in which the developing roller is in contact with the photosensitive drum. However, in the image forming apparatus, an initializing action, in which the cam may be rotated reversely in a direction opposite to the normal rotating direction when an image is being formed, may not be taken into consideration.

The present disclosure is advantageous in that an image forming apparatus with a developing roller being movable to contact and separate from a photosensitive drum, which is capable of conducting an initializing action in a shorter period based on a movement of a cover, and in which a cam may be stopped accurately at a correct phase, is provided.

According to an aspect of the present disclosure, an image forming apparatus, including a casing, a cover, a photosensitive drum, a developing roller, a photo-interrupter, a moving mechanism, and a controller, is provided. The casing has an opening. The cover is movable between a closed position, at which the opening is closed by the cover, and an open position, at which the opening is exposed. The photo-interrupter includes a light-emitter and a light-receiver. The moving mechanism is configured to move the developing roller between a contacting position, at which the developing roller contacts the photosensitive drum, and a separated position, at which the developing roller is separated from the photosensitive drum. The moving mechanism includes a cam and a cam follower. The cam is configured to rotate about a rotation axis bidirectionally in a normal direction and a reverse direction. The cam includes a first cam portion and a phase-detector wall. The phase-detector wall extends in a circumferential direction centered at the rotation axis of the cam. The phase-detector wall has a first slit, through which light emitted from the light-emitter is allowed to pass the phase-detector wall when the developing roller is at the separated position, and a second slit, through which the light emitted from the light-emitter is allowed to pass the phase-detector wall when the developing roller is at the contacting position. The second slit has a different size in the circumferential direction from the first slit. The cam follower is slidably movable between a protrusive position and a standby position and being pivotable between an operable position and an inoperable position. The cam follower includes a contacting portion and an arm. The contacting portion is configured to contact the first cam portion. The arm extends in a direction different from the contacting portion. The controller is configured to, when the cover moves from the open position to the closed position, conduct a first initializing control, in which the controller causes the cam to rotate in the reverse direction and, after detecting the first slit based on a time period, in which the light emitted from the light-emitter passes through one of the first slit and the second slit, causes the cam to stop rotating.

According to another aspect of the present disclosure, an image forming apparatus, including a casing, a cover, a photosensitive drum, a developing roller, a photo-interrupter, a moving mechanism, and a controller, is provided. The casing has an opening. The cover is movable between a closed position, at which the opening is closed by the cover, and an open position, at which the opening is exposed. The photo-interrupter includes a light-emitter and a light-receiver. The moving mechanism is configured to move the developing roller between a contacting position, at which the developing roller contacts the photosensitive drum, and a separated position, at which the developing roller is separated from the photosensitive drum. The moving mechanism includes a cam and a cam follower. The cam is configured to rotate about a rotation axis bidirectionally in a normal direction and a reverse direction. The cam includes a first cam portion and a phase-detector wall. The phase-detector wall extends in a circumferential direction centered at the rotation axis of the cam. The phase-detector wall has a first slit, through which light emitted from the light-emitter is allowed to pass the phase-detector wall when the developing roller is at the separated position, and a second slit, through which the light emitted from the light-emitter is allowed to pass the phase-detector wall when the developing roller is at the contacting position. The second slit has a different size in the circumferential direction from the first slit. The cam follower is slidably movable between a protrusive position and a standby position and being pivotable between an operable position and an inoperable position. The cam follower includes a contacting portion and an arm. The contacting portion is configured to contact the first cam portion. The arm extends in a direction different from the contacting portion. The controller is configured to, when the cover moves from the open position to the closed position, conduct a first initializing control, in which the controller causes the cam to rotate in the reverse direction and, after detecting the first slit based on a time period, in which the light emitted from the light-emitter passes through one of the first slit and the second slit, causes the cam to stop rotating.

According to another aspect of the present disclosure, an image forming apparatus, including a casing, a cover, a photosensitive drum, a developing roller, a moving mechanism, a photo-interrupter, and a controller, is provided. The casing has an opening. The cover is movable between a closed position, where the cover covers the opening, and an open position, where the cover does not cover the opening. The moving mechanism is configured to move the developing roller between a contacting position, at which the developing roller contacts the photosensitive drum, and a separated position, at which the developing roller is separated from the photosensitive drum. The moving mechanism includes a cam configured to rotate about a rotation axis bidirectionally in a normal direction and a reverse direction. The cam includes a phase-detector wall extending in a circumferential direction centered at the rotation axis of the cam. The phase-detector wall has a first slit and a second slit having a different size in the circumferential direction from the first slit. The photo-interrupter includes a light-emitter and a light-receiver. The controller is configured to, when the cover moves from the open position to the closed position, start rotating the cam in the reverse direction; after starting rotating the cam in the reverse direction, detect the first slit based on a time period, in which light emitted from the light-emitter passes through one of the first slit and the second slit; and after detecting the first slit, stop rotating the cam.

BRIEF DESCRIPTION OF THE ACCOMPANYING DRAWINGS

FIG. 13 is a flowchart to illustrate flows of steps to be conducted by a controller according to the embodiment of the present disclosure when the image forming apparatus is powered on.

Figure 22A:
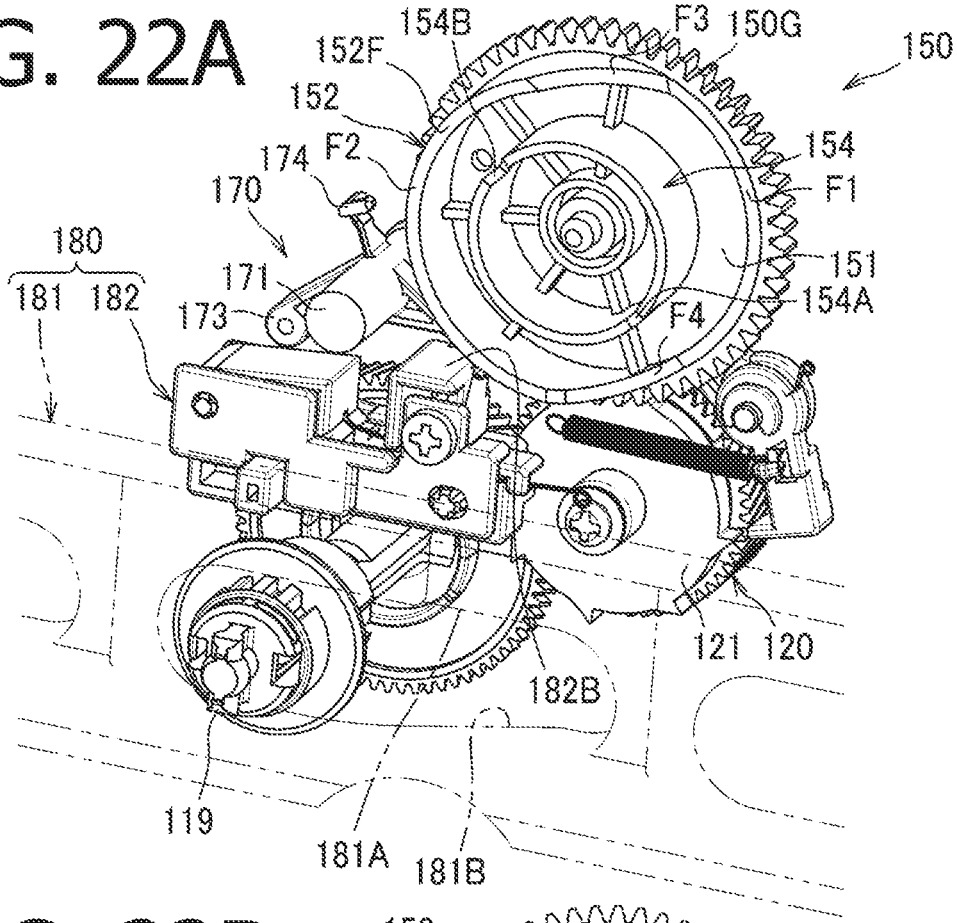
FIGS. 22A and 22B are a perspective view and a side view, respectively, of the cam, the cam follower, and the releasing member in the image forming apparatus according to the embodiment of the present disclosure when the cover moved from the open position is at the closed position.
Figure 22B:
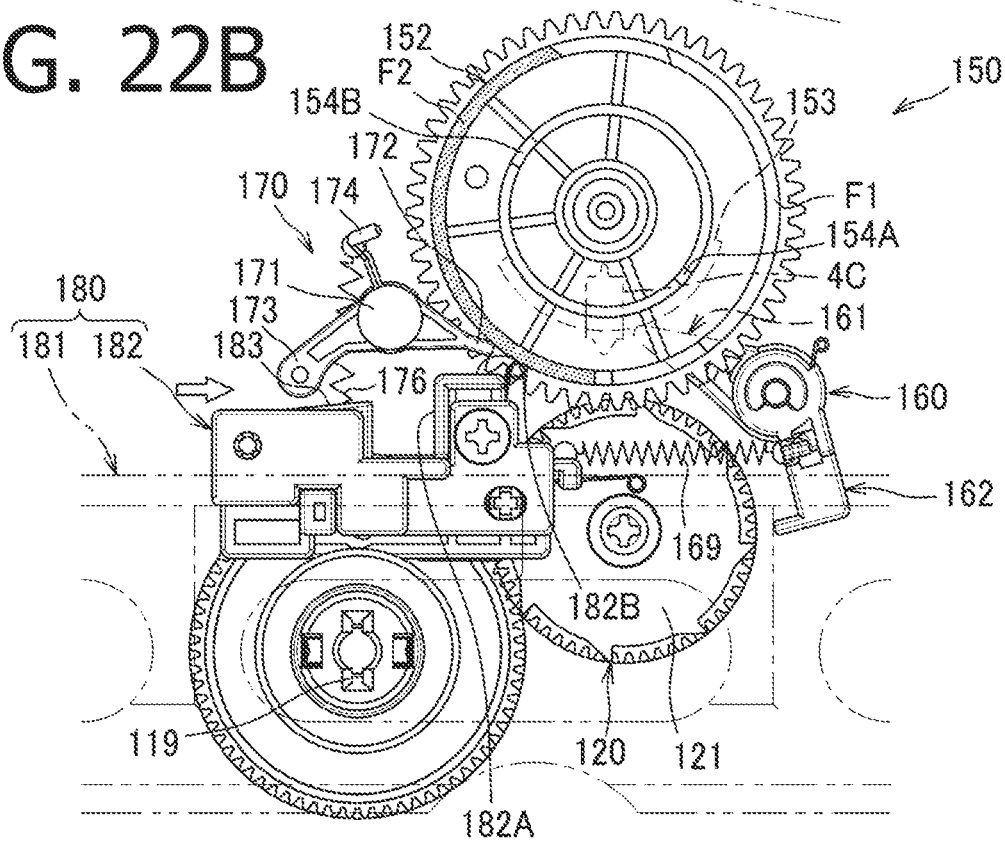
Figure 23A:
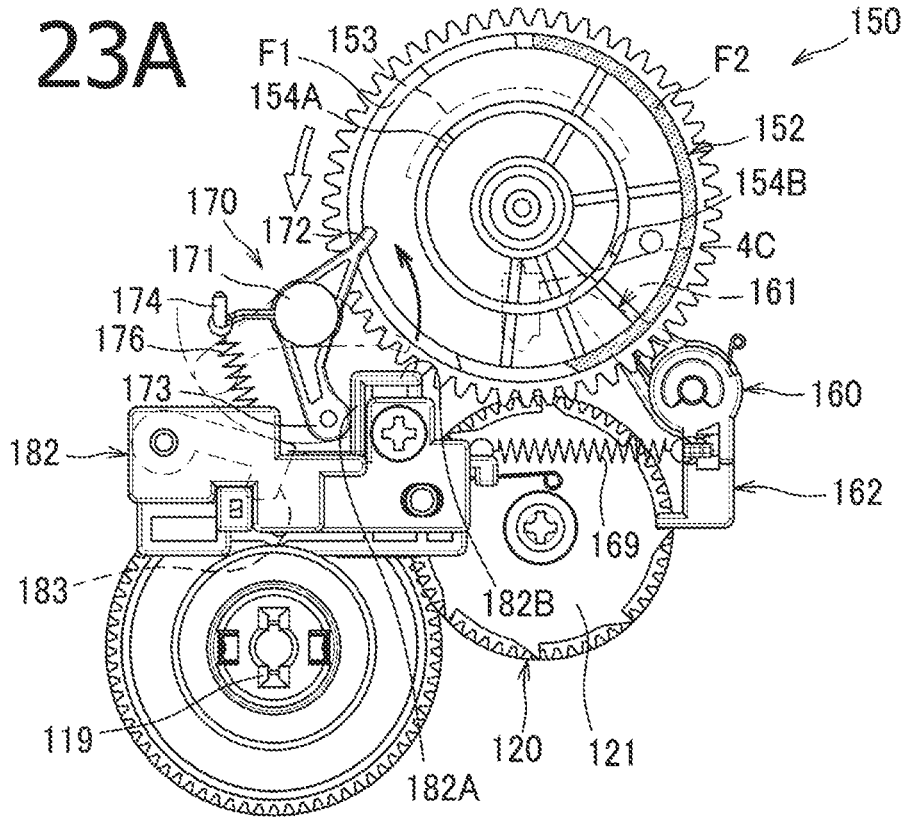
Figure 23B:
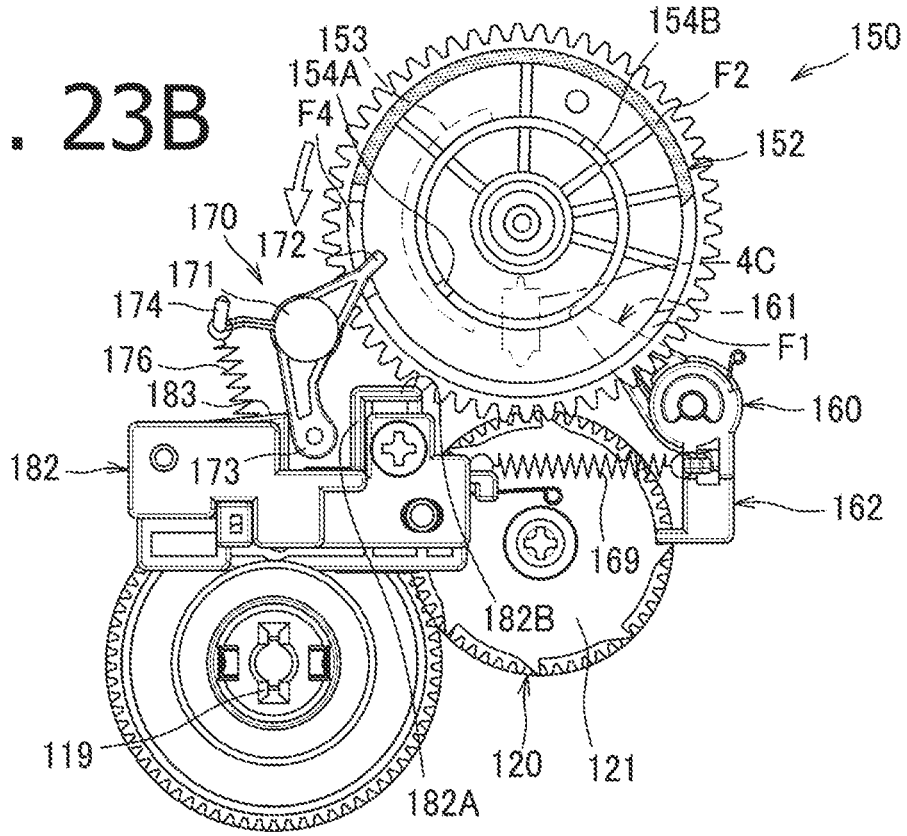

FIG. 23A is a side view of the cam, the cam follower, and the releasing member in the image forming apparatus according to the embodiment of the present disclosure when the cam rotates in a reverse direction from the position shown in FIGS. 22A-22B and the cam follower returning from an inoperable position to an operable position. FIG. 23B is a side view of the cam, the cam follower, and the releasing member in the image forming apparatus according to the embodiment of the present disclosure when the cam rotates in the reverse direction from the position shown in FIG. 23A and the stopper restricts the cam follower from rotating.

Figure 24A:
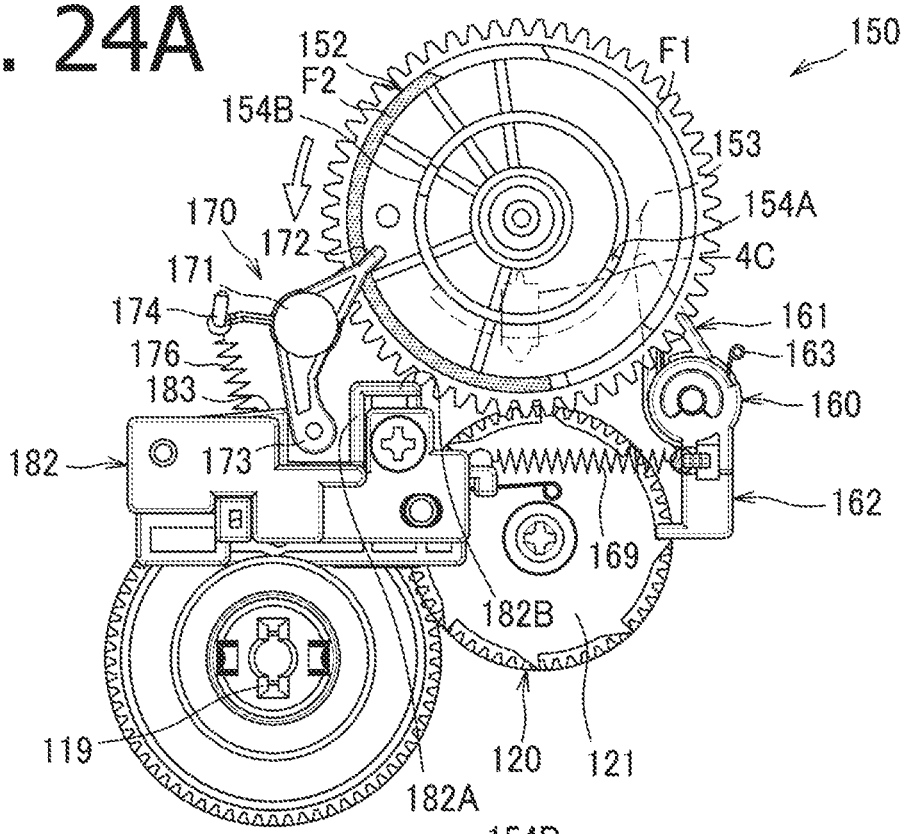

FIG. 24A is a side view of the cam, the cam follower, and the releasing member in the image forming apparatus according to the embodiment of the present disclosure when the cam rotates in the reverse direction further from the position shown in FIG. 23B, the developing roller is at the separated position, and the first lever is at a swung position.

Figure 24B:
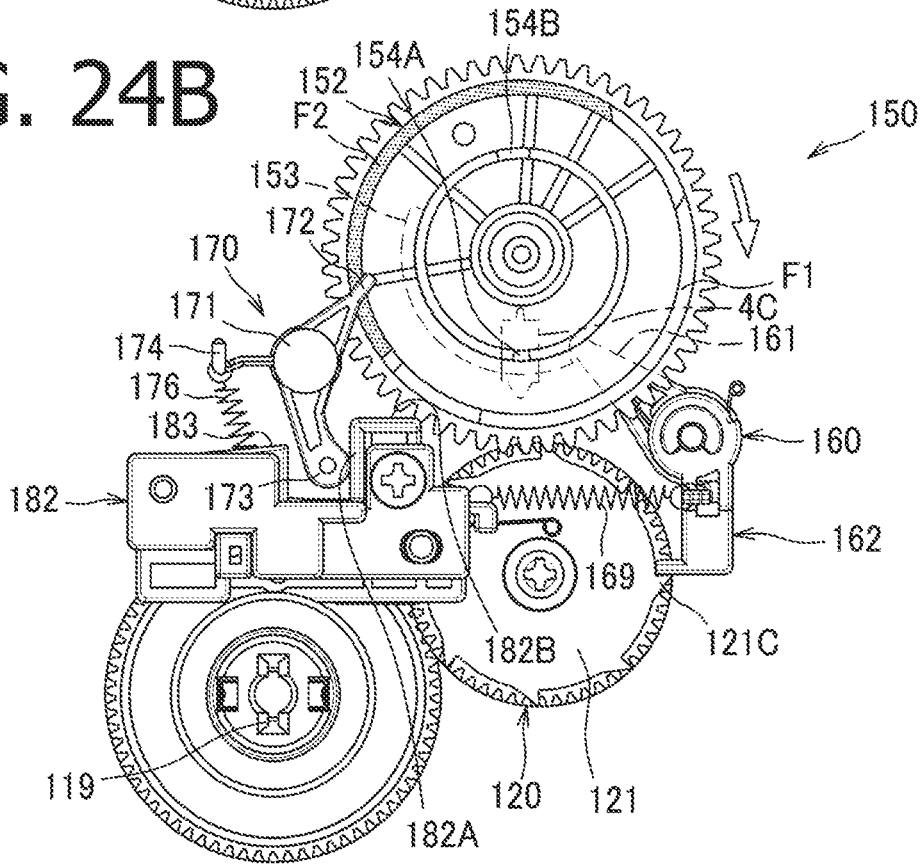

FIG. 24B is a side view of the cam, the cam follower, and the releasing member in the image forming apparatus according to the embodiment of the present disclosure when the cam rotated in the normal direction from the position shown in FIG. 24A is at an initial position.

Figure 25:
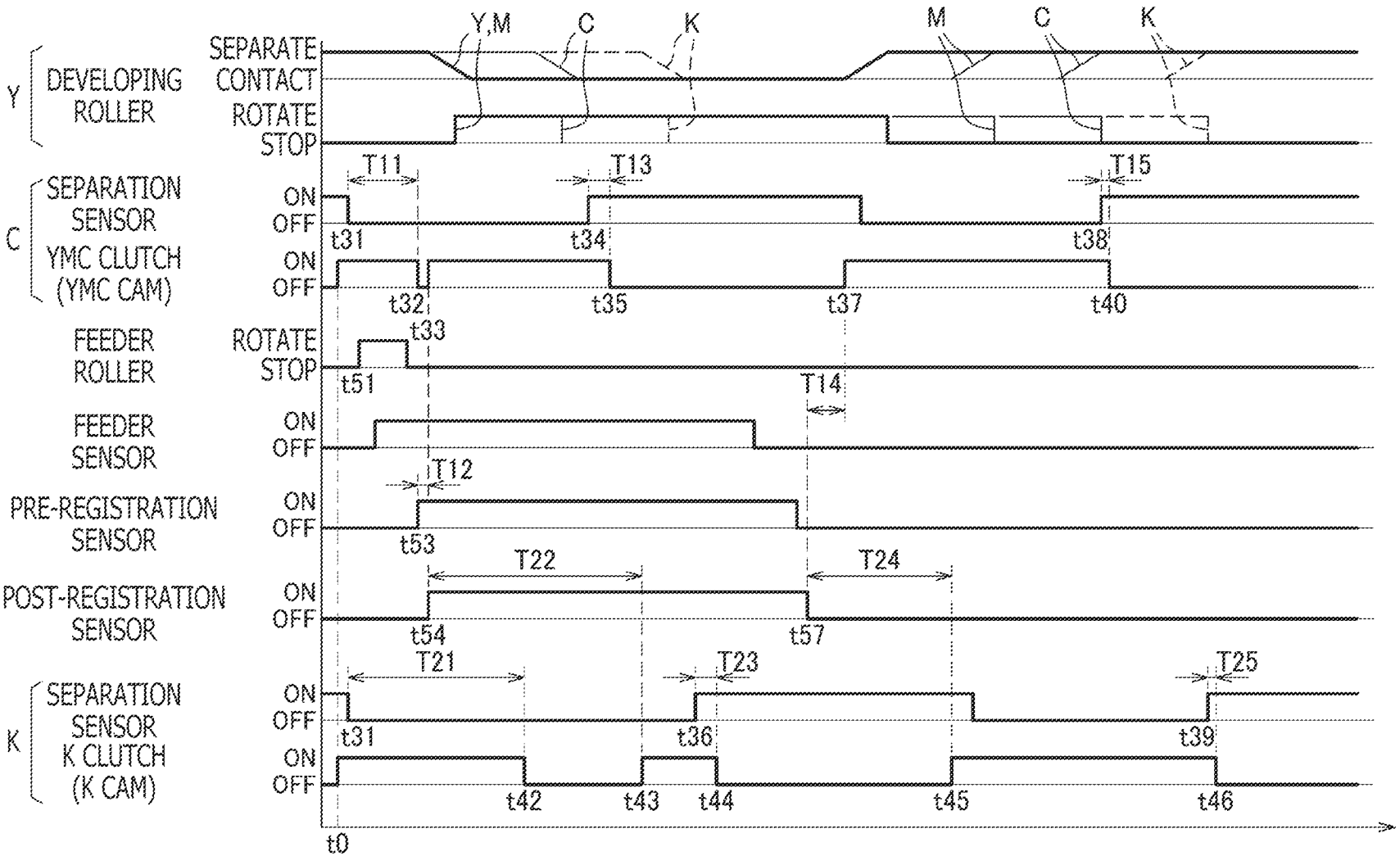

FIG. 25 is a timing chart to illustrate movements of the developing rollers, separation sensors, a feed roller, a sheet-feed sensor, a pre-registration sensor, and a post-registration sensor in the image forming apparatus according to the embodiment of the present disclosure.

DETAILED DESCRIPTION

Hereinafter, described with reference to the accompanying drawings will be an embodiment of the present disclosure.

Figure 1:
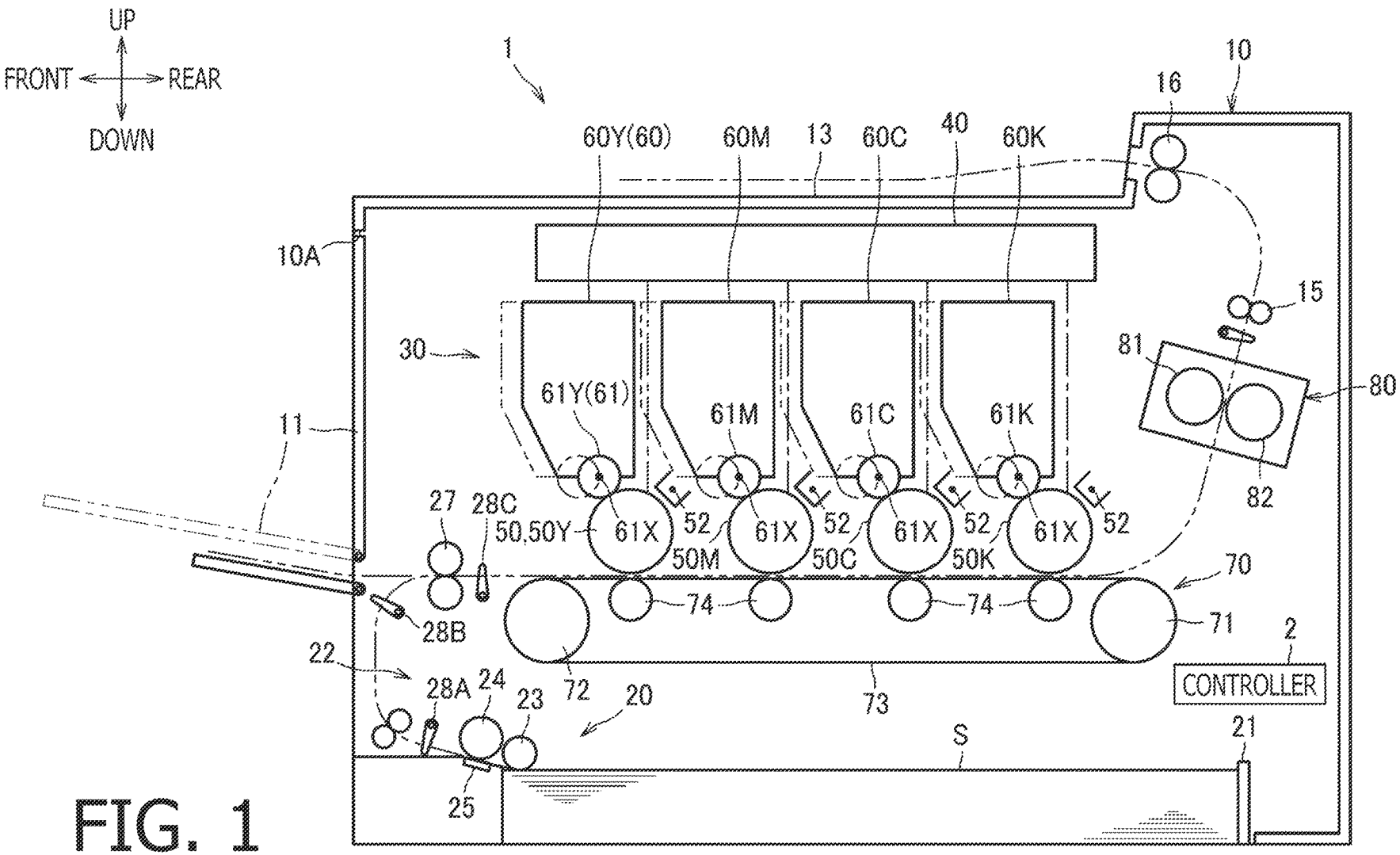
FIG. 1 is an overall cross-sectional view of an image forming apparatus according to an embodiment of the present disclosure.

As shown in FIG. 1, an image forming apparatus 1 according to the present embodiment may be a multicolor printer and has a casing 10, a cover 11, a sheet feeder 20, an image forming device 30, and a controller 2.

In the following description, directions related the image forming apparatus 1 and parts or items included in the image forming apparatus 1 will be referred to on basis of indications by arrows in FIG. 1. For example, in FIG. 1, a viewer's a left-hand side, a right-hand side, an upper side, and a lower side will be referred to as a front side, a rear side, an upper side, and a lower side, respectively. Moreover, the viewer's farther side and nearer side in FIG. 1 will be referred to as a leftward side and a rightward side in the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction.

The casing 10 has a first opening 10A on the front side thereof. The cover 11 is movable between a closed position, in which the cover 11 closes the first opening 10A, as indicated by solid lines in FIG. 1, and an open position, in which the first opening 10A is exposed open, as shown in dash-and-dots lines in FIG. 1. On the casing 10, arranged is a cover sensor, which is not shown, to detect the position of the cover 11 being at the open or closed position. The controller 2 may determine the position of the cover 11 being at the open or closed position based on signals from the cover sensor.

The sheet feeder 20 is arranged at a lower position in the casing 10 and includes a sheet tray 21 to store sheet(s) S and a feeder device 22 to feed the sheets S from the sheet tray 21 to the image forming device 30. The sheet tray 21 is movable to be pulled frontward, i.e., leftward in FIG. 1, to be detached from the casing 10. The feeder device 22 is arranged at a frontward position in the casing 10 and includes a feeder roller 23, a separator roller 24, a separator pad 25, and a registration roller 27. The sheet(s) S in the present embodiment is a printing medium, on which the image forming apparatus 1 may form an image, and includes, but not necessarily be limited to, regular paper, envelope, postcard, tracing paper, cardboard, resin sheet, and sticker sheet.

In the sheet feeder 20, one of the sheets S in the sheet tray 21 may be picked up by the feeder roller 23 and separated from the other sheets S by the separator roller 24 and the separator pad 25. As the separated sheet S is conveyed further, a position of a leading edge of the sheet S may be regulated by the registration roller 27, which may be pausing. Thereafter, as the registration roller 27 starts rotating, the sheet S may be fed to the image forming device 30.

A feeder sensor 28A, a pre-registration sensor 28B, and a post-registration sensor 28C are arranged in the sheet-feeder 20. The feeder sensor 28A is located at a position downstream from the feeder roller 23 and the separator roller 24 in a conveying direction to convey the sheet S. The pre-registration sensor 28B is located at a position upstream from the registration roller 27 in the conveying direction. The post-registration sensor 28C is located at a position downstream from the registration roller 27 in the conveying direction.

The image forming device 30 includes an exposure device 40, a drawer 90 (see FIG. 2), a plurality of developing cartridges 60, a conveyer 70, and a fuser 80. The drawer 90 includes a plurality of photosensitive drums 50.

The exposure device 40 includes laser diodes, deflectors, lenses, and mirrors, which are not shown. The exposure device 40 may emit laser beams at the photosensitive drums 50 to expose the photosensitive drums 50 to the light and to scan surfaces of the photosensitive drums 50.

The photosensitive drums 50 include a first photosensitive drum 50Y corresponding to a color of yellow, a second photosensitive drum 50M corresponding to a color of magenta, a third photosensitive drum 50C corresponding to a color of cyan, and a fourth photosensitive drum 50K corresponding to a color of black. In the following paragraphs and the accompanying drawings, a color to which an item corresponds may be identified by a suffix Y, M, C, or K, representing yellow, magenta, cyan, or black, respectively, appended to a reference sign of the item. On the other hand, when items are described generally without necessity of referring to the corresponding colors thereto, the items may be described representatively in a singular form with a single reference sign without the suffix Y, M, C, or K; and the ordinal terms (e.g., first, second, etc.) may be omitted.

The developing cartridge 60 is provided correspondingly to the photosensitive drum 50. In particular, the developing cartridge 60 includes a first developing cartridge 60Y, a second developing cartridge 60M, a third developing cartridge 60C, and a fourth developing cartridge 60K. The first developing cartridge 60Y includes a first developing roller 61Y, which may supply yellow toner to the first photosensitive drum 50Y. The second developing cartridge 60M includes a second developing roller 61M, which may supply magenta toner to the second photosensitive drum 50M. The third developing cartridge 60C includes a third developing roller 61C, which may supply cyan toner to the third photosensitive drum 50C. The fourth developing cartridge 60K includes a fourth developing roller 61K, which may supply black toner to the fourth photosensitive drum 50K.

The first developing roller 61Y, the second developing roller 61M, the third developing roller 61C, and the fourth developing roller 61K are arranged in line in this recited order from upstream to downstream along a sheet-moving direction. In other words, the first developing roller 61Y is at a most upstream position, and the fourth developing roller 61K is at a most downstream position, in the sheet-moving direction for the sheet S. The sheet-moving direction is a direction, in which the sheet S is conveyed in the conveyer 70 (e.g., rearward in FIG. 1 and rightward to a viewer).

The developing cartridge 60 is movable between a position, in which the developing roller 61 being at a contacting position contacts the corresponding photosensitive drum 50, as indicated by solid lines in FIG. 1, and a position, in which the developing roller 61 being at a separated position is separated from the corresponding photosensitive drum 50, as indicated by dash-and-dots lines in FIG. 1.

Figure 2:
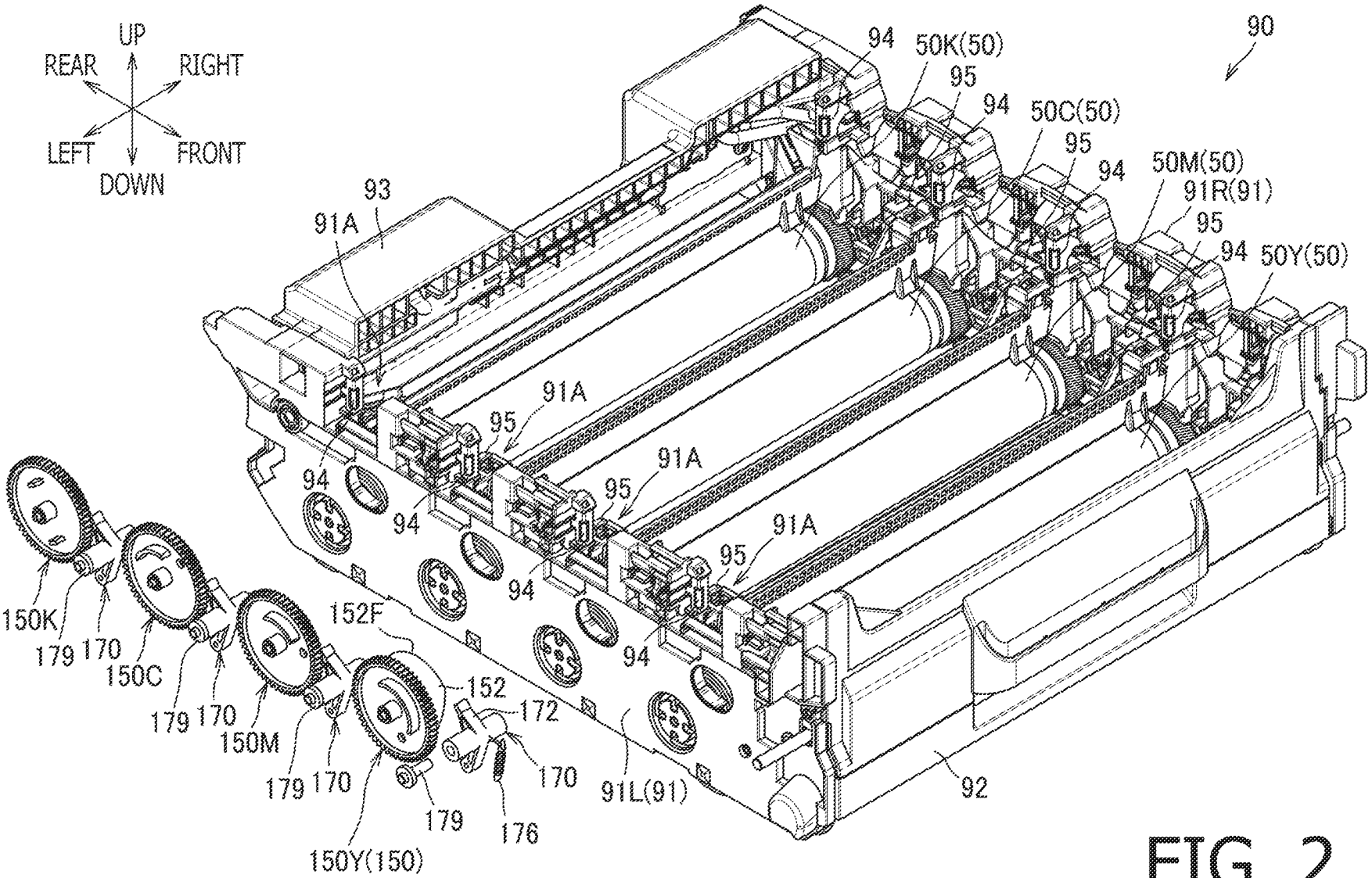
FIG. 2 is a perspective view of a drawer, cams, and cam followers in the image forming apparatus according to the embodiment of the present disclosure.

As shown in FIG. 2, the photosensitive drum 50 is rotatably supported by the drawer 90. The drawer 90 supports the developing cartridge 60 removably. The drawer 90 is detachably attachable to the casing 10 through the first opening 10A, which is exposed when the cover 11 (see FIG. 1) of the casing 10 is open. The drawer 90 includes a side frame 91 and connecting frames 92, 93. The side frame 91 includes a pair of a side frame 91R on the right and a side frame 91L on the left, which are spaced apart from each other in an axial direction of the photosensitive drum 50. The connecting frame 92 connects the side frame 91R and the side frame 91L with each other at a frontward position, and the connecting frame 93 connects the side frame 91R and the side frame 91L with each other at a rearward position. On the drawer 90, arranged is a charger 52 (see FIG. 1), which may electrically charge the photosensitive drum 50.

Although illustration of the detailed structure of the side frame 91 is omitted, the side frame 91, i.e., the pair of side frames 91R, 91L, may support ends of the photosensitive drum 50. One of the side frames 91R, 91L, e.g., the side frame 91L on the left, has second openings 91A. The second openings 91A may be cutouts formed to dent downward from an upper edge of the side frame 91L. Thus, the second openings 91A are formed through the side frame 91L in the widthwise direction, and cam followers 170, which will be described in detail below, may be accepted in the second openings 91A.

The image forming apparatus 1 has four (4) moving mechanisms, each of which may move one of the first, second, third, and fourth developing rollers 61Y, 61M, 61C, 61K between the contacting position, in which the developing roller 61 contacts the corresponding photosensitive drum 51, and the separated position, in which the developing roller 61 is separated from the corresponding photosensitive drum 51. Thus, four (4) moving mechanisms are provided for the first, second, third, and fourth colors on one-to-one basis.

Figure 7:
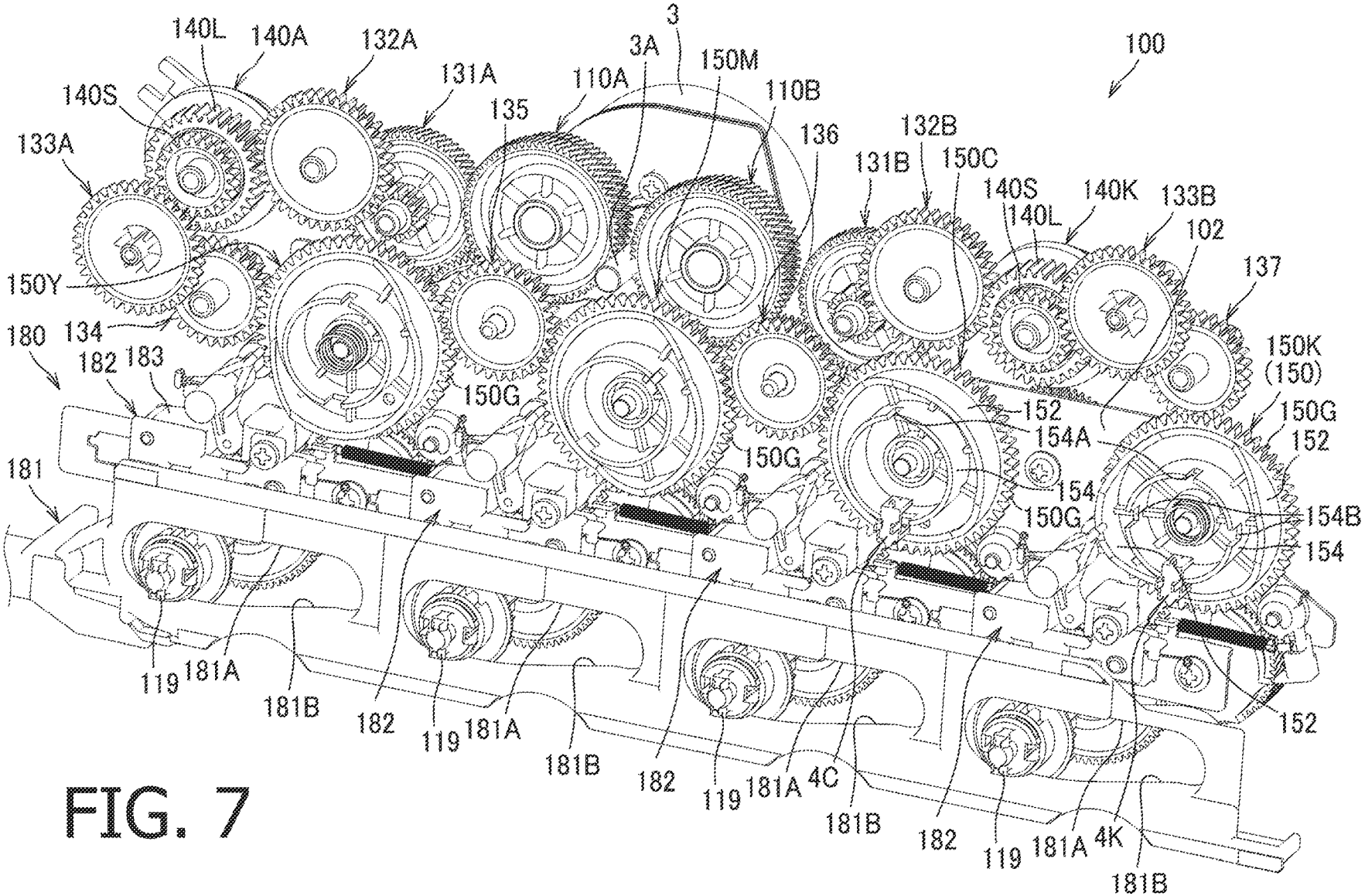
FIG. 7 is a perspective view of the driving-force transmitter in the image forming apparatus according to the embodiment of the present disclosure from an upper-right viewpoint.

Each moving mechanism includes a cam 150, a supporting shaft 179, a cam follower 170, a first spring 176, and a releasing member 180 (see FIG. 7). The cam 150 is rotatable about an axis, which is parallel to a rotation axis 61X (see FIG. 1) of the developing roller 61 and includes a cam 150Y for yellow, a cam 150M for magenta, a cam 150C for cyan, and a cam 150K for black. Each cam 150 includes a first cam portion 152 protruding in a rotation-axis direction, which is a direction of the rotation axis 61X of the developing roller 61.

The supporting shaft 179 extends in the widthwise direction. The supporting shaft 179 is arranged on a side frame in the casing 10, which is not shown.

The cam follower 170 engages with the supporting shaft 179. The cam follower 170 is slidably movable along an axial direction of the supporting shaft 179 and is pivotable about the axis of the supporting shaft 179. The cam follower 170 includes a contact portion 172, which may contact the first cam portion 152 of the cam 150.

Figure 4A:
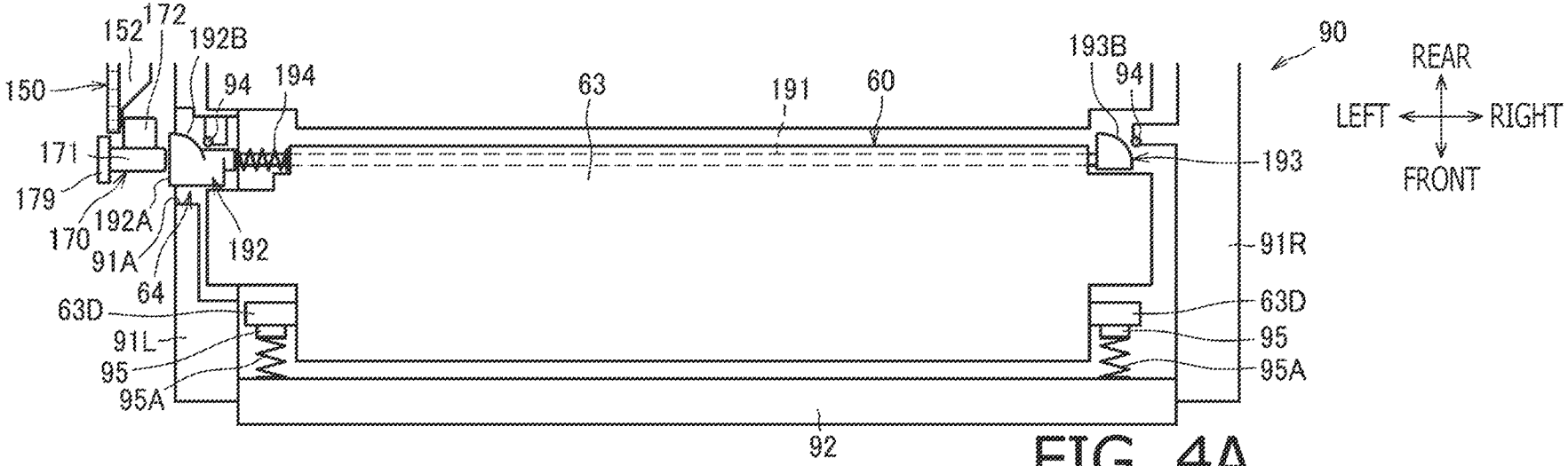
FIG. 4A is an illustrative view of the developing cartridge and periphery thereof when the cam follower is at a standby position.
Figure 4B:
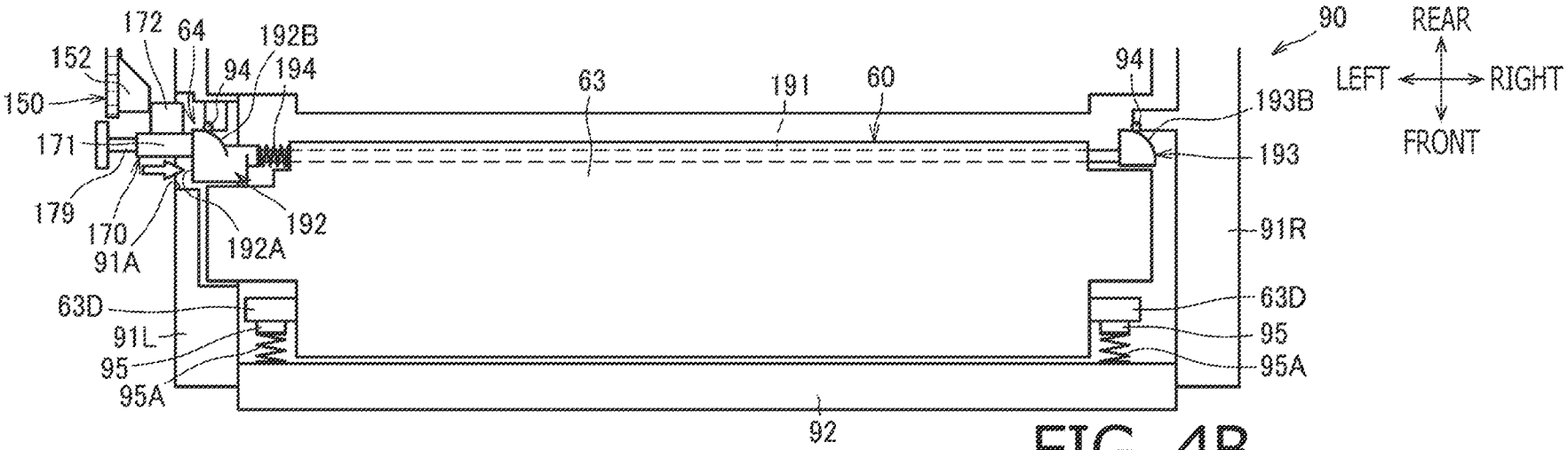
FIG. 4B is an illustrative view of the developing cartridge and the periphery thereof when the cam follower is at a protrusive position.
Figure 20A:
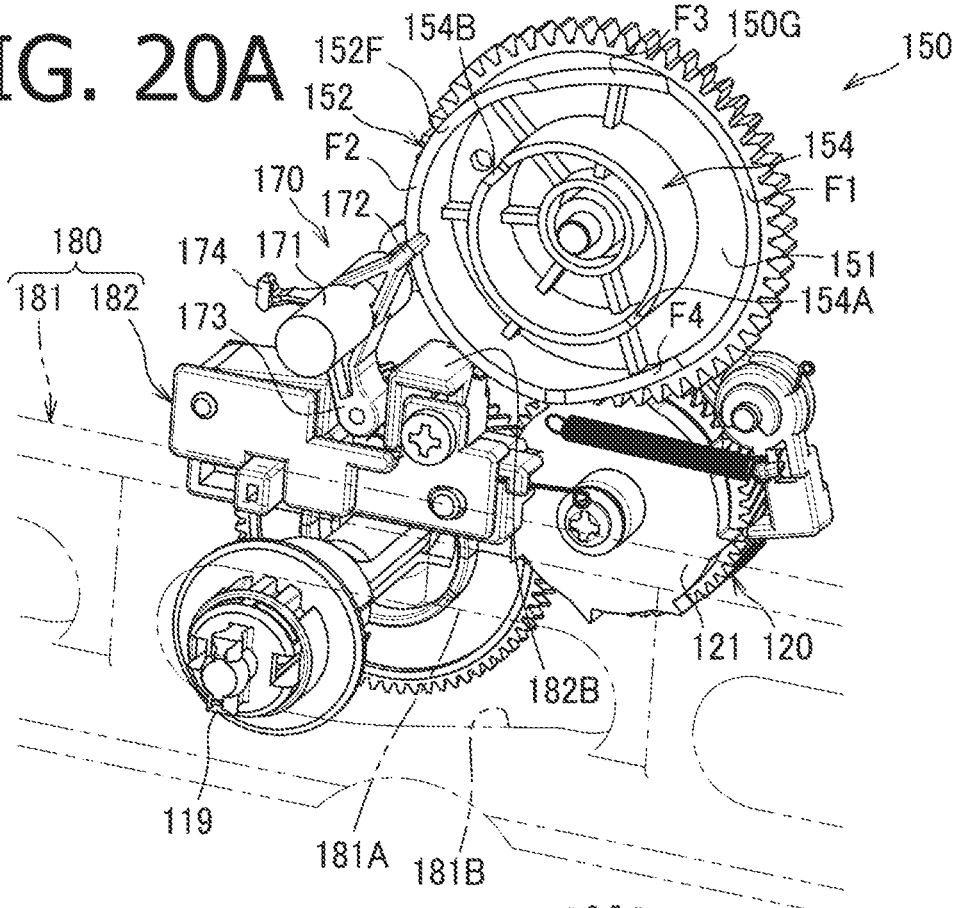
FIGS. 20A and 20B are a perspective view and a side view, respectively, of the cam, the cam follower, and the releasing member in the image forming apparatus according to the embodiment of the present disclosure, when the cam rotates in the normal direction and the developing roller is at a separated position.
Figure 20B:
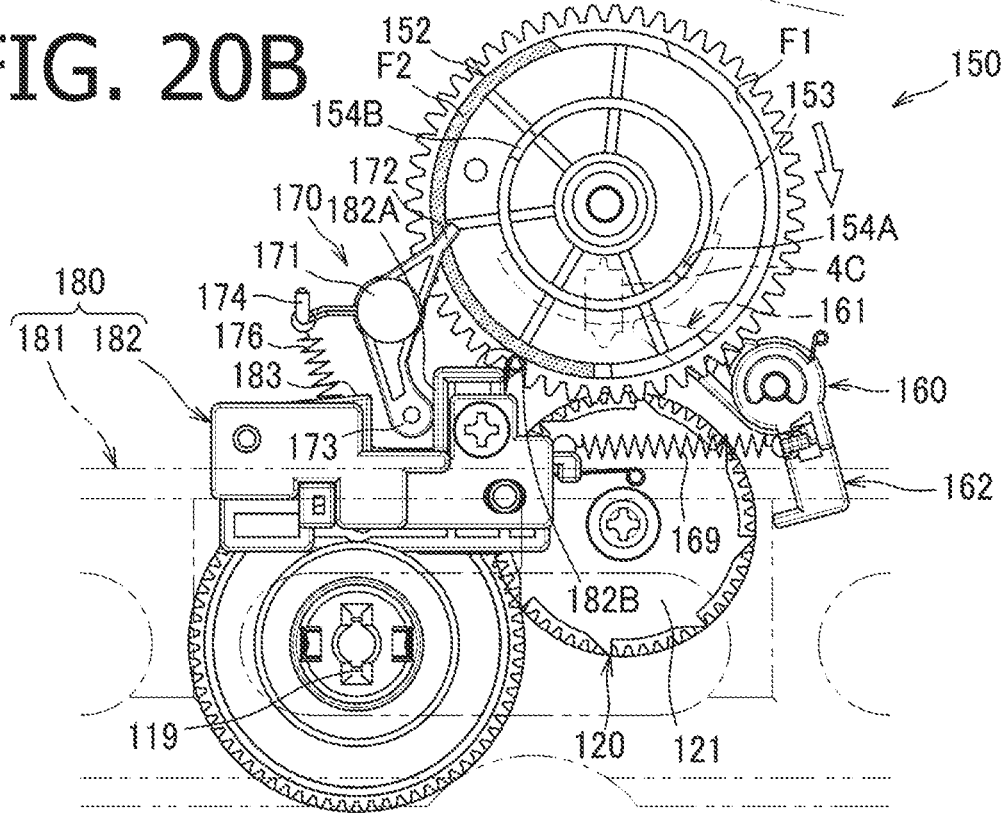
Figure 21A:
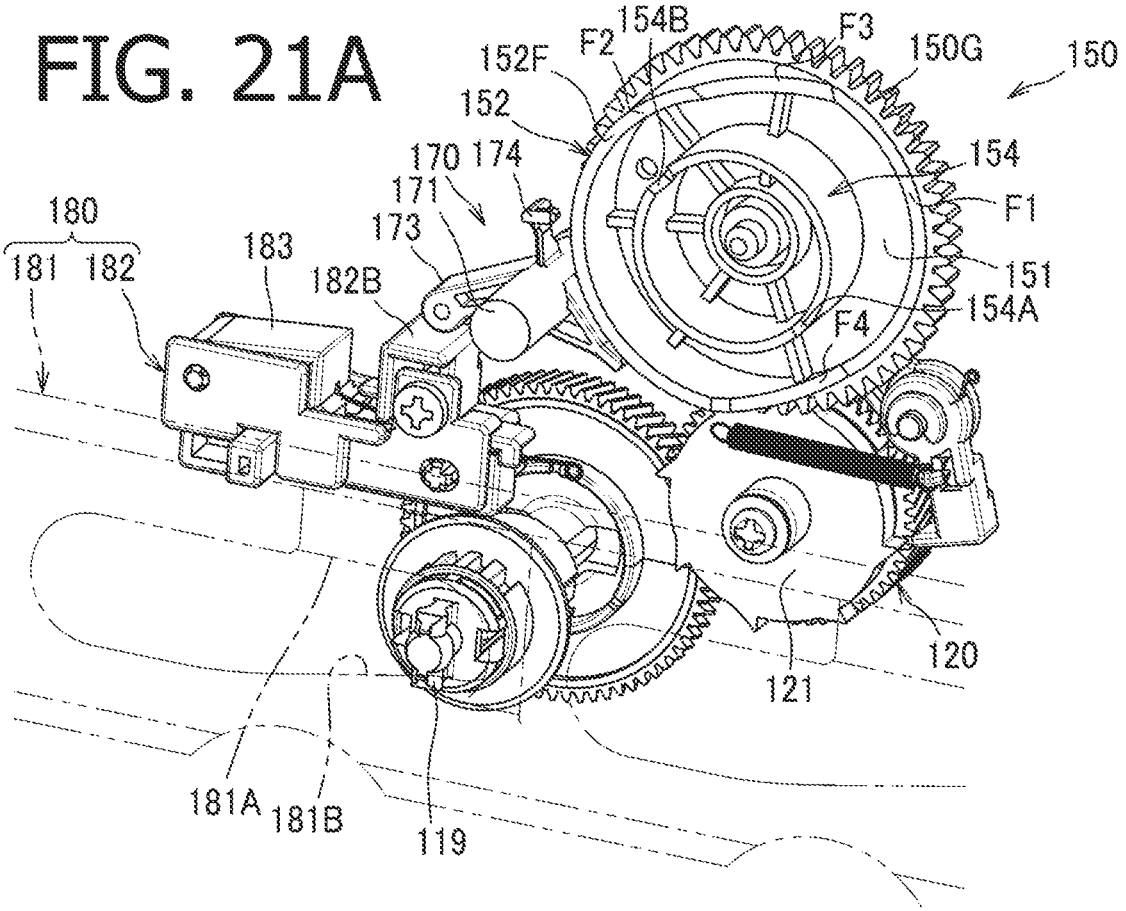
FIGS. 21A and 21B are a perspective view and a side view, respectively, of the cam, the cam follower, and the releasing member in the image forming apparatus according to the embodiment of the present disclosure when the cover is at the open position.
Figure 21B:
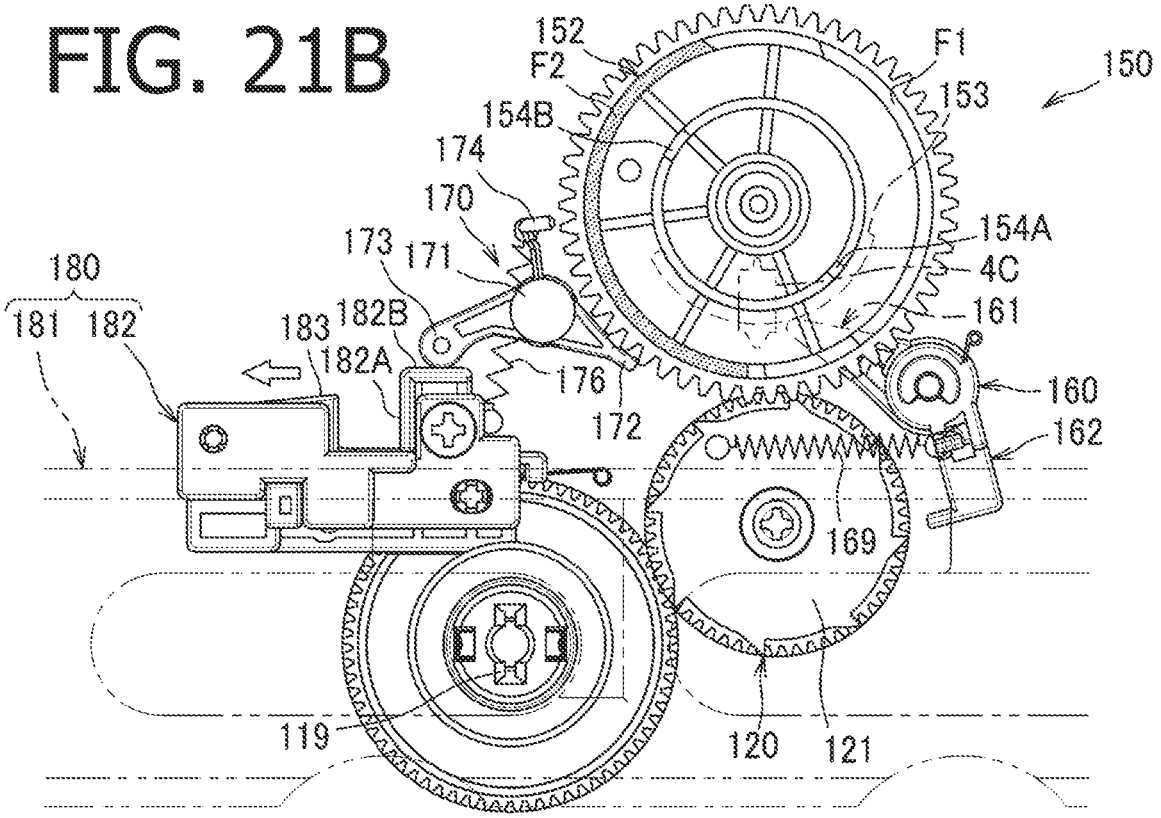

The cam follower 170 is movable between an operable position, in which the contact portion 172 contacts an end face of the first cam portion 152, as shown in FIGS. 20A-20B, and an inoperable position, which the contact portion 172 does not contact the end face of the first cam portion 152, as shown in FIGS. 21A-21B. When the cam follower 170 is at the inoperable position, the cam follower 170 does not overlap the first cam portion 152 in a view along the rotation-axis direction. On the other hand, when the cam follower 170 is at the operable position, the cam follower 170 may contact a cam face 152F being the end face of the first cam portion 152 and, as the cam 150 rotates, may slide in the axial direction to move between a protrusive position, in which the cam follower 170 locates the developing roller 61 at the separated position, as shown in FIG. 4B, and a standby position, in which the cam follower 170 locates the developing roller 61 at the contact position, as shown in FIG. 4A.

When the cam follower 170 is located at the protrusive position, the cam follower 170 is received in the second opening 91A in the side frame 91L and urges the developing cartridge 60 to locate the developing roller 61 at the separated position. When the cam follower 170 is located at the standby position, the cam follower 170 is outside the second opening 91A and causes the developing roller 61 to be located at the contacting position. Meanwhile, when the cam follower 170 is at the inoperable position, due to the releasing member 180 moving along with the cover 11 moving from the open position to the closed position, the contact portion 172 is not guided on the first cam portion 152; therefore, the cam follower 170 is maintained at the standby position irrespectively from the rotation of the cam 150.

Referring back to FIG. 2, the cam 150 and the cam follower 170 are arranged to correspond to each of the first, second, third, fourth developing cartridges 60Y, 60M, 60C, 60K. The cam 150 and the cam follower 170 are arranged at a widthwise outer position with respect to the side frame 91L. In other words, the cam 150 and the cam follower 170 are arranged at a leftward position with respect to the side frame 91L. The cam 150, the cam follower 170, and the releasing member 180 will be described further below.

At upper positions with respect to the side frames 91R, 91L in the drawer 90, arranged are contact portions 94. Each contact portion 94 may contact a slider member 64, which will be described further below. The contact portion 94 includes a roller, and while the axial direction of the photosensitive drum 50 extends in a first direction, and the first, second, third, and fourth photosensitive drums 50Y, 50M, 50C, 50K align along a second direction, the roller in the contact portion 94 may rotate about an axis extending along a third direction, e.g., vertical direction, which extends orthogonally to the first direction and to the second direction.

The drawer 90 includes pressing members 95 for the first, second, third, and fourth developing cartridges 60Y, 60M, 60C, 60K. In particular, two (2) pressing members 95 may be provided for each of the first, second, third, and fourth developing cartridges 60Y, 60M, 60C, 60K. The pressing members 95 are arranged at one and the other ends of the corresponding developing cartridge 60 in the axial direction of the photosensitive drum 50. The pressing members 95 are urged rearward by springs 95A (see FIGS. 4A-4B). When the developing cartridge 60 is attached to the drawer 90, the pressing members 95 may press protrusions 63D in the developing cartridge 60 to place the developing roller 61 to contact the photosensitive drum 50.

Figure 3A:
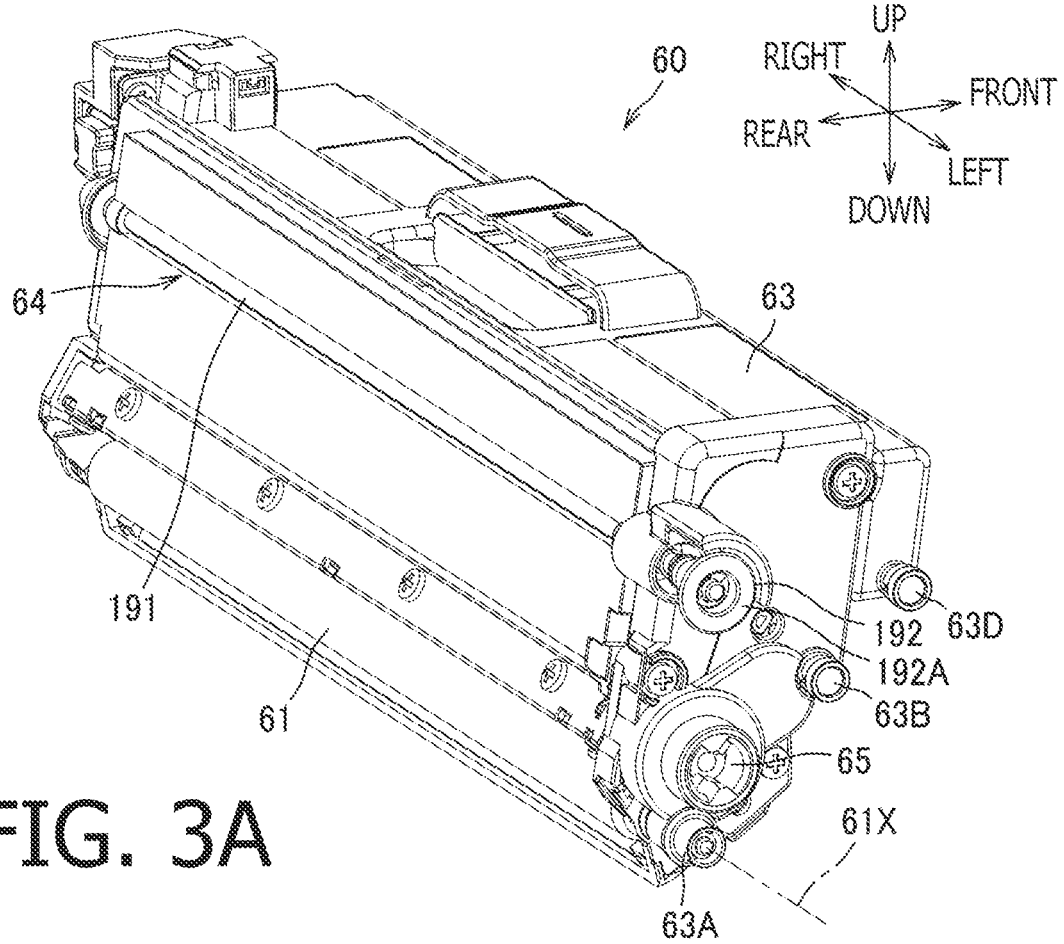
FIG. 3A is a perspective view of a developing cartridge for the image forming apparatus according to the embodiment of the present disclosure.
Figure 3B:
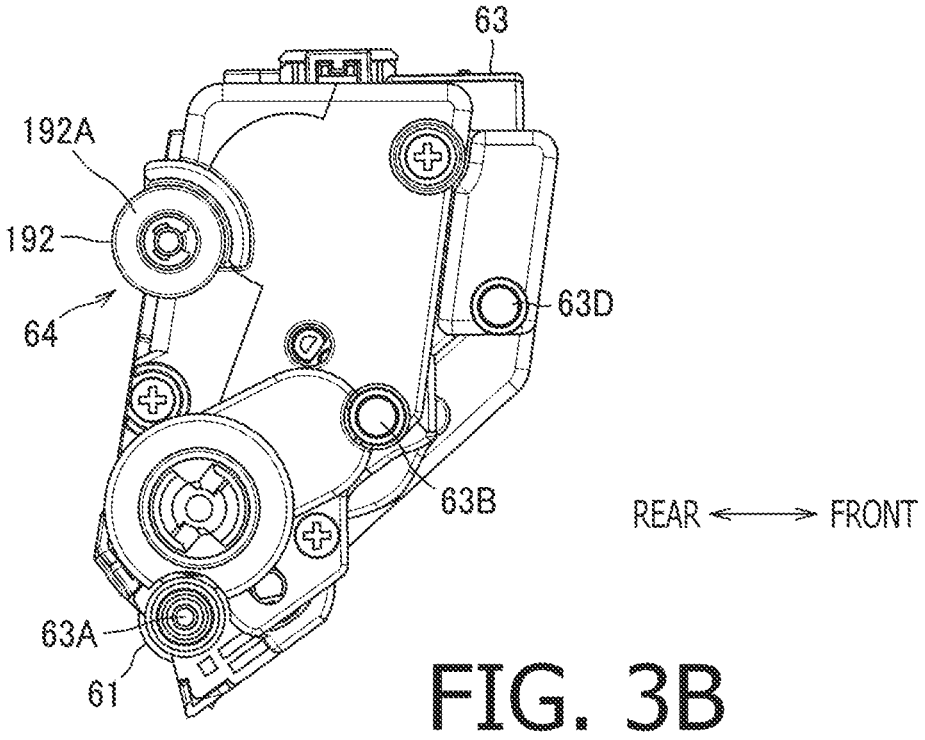
FIG. 3B is a side view of the developing cartridge for the image forming apparatus according to the embodiment of the present disclosure.

The developing cartridge 60 as shown in FIGS. 3A-3B, which is any one of the first, second, third, and fourth developing cartridges 60Y, 60M, 60C, 60K, includes a case 63 to contain toner, a slider member 64, and a coupling 65.

The case 63 has a first protrusive portion 63A and a second protrusive portion 63B, which protrude in the rotation-axis direction, on one sideward face, e.g., a leftward face, thereof. The first protrusive portion 63A is arranged coaxially with the rotation axis 61X of the developing roller 61 and protrudes in the rotation-axis direction. The second protrusive portion 63B is arranged at a position apart from the first protrusive portion 63A for a predetermined distance. The second protrusive portion 63B is arranged at an upper position with respect to the first protrusive portion 63A. The first protrusive portion 63A and the second protrusive portion 63B are rollers, which are rotatable about axes extending in parallel with the rotation-axis direction. Although not shown in the drawings, on the other sideward face, e.g., a rightward face, of the case 63 in the widthwise direction, arranged are a first protrusive portion and a second protrusive portion, which are in the same forms as the first protrusive portion 63A and the second protrusive portion 63B, respectively, at widthwise symmetrical positions.

The case 63 includes a protrusion 63D to be pressed by the pressing member 95 at a frontward position on each sideward face thereof. Thus, the protrusions 63D are arranged at end faces of the case 63 in the rotation-axis direction.

The coupling 65 may engage with a coupling shaft 119, which will be described further below, so that a rotation-driving force may be input from the coupling shaft 119 to the coupling 65.

The slider member 64 is slidable to move in the rotation-axis direction with respect to the case 63. The slider member 64 may be pressed by the cam follower 170 to slidably move in the rotation-axis direction.

As shown in FIGS. 4A-4B, the slider member 64 includes a shaft 191, a first contact member 192, and a second contact member 193. The first contact member 192 is fixed to one end, e.g., a leftward end, of the shaft 191, and the second contact member 193 is fixed to the other end, e.g., a rightward end, of the shaft 191.

The shaft 191 is arranged to extend through the case 63 via holes, which are formed in the rotation-axis direction in the case 63, to be slidably supported by the case 63.

The first contact member 192 includes a pressing face 192A, which is an end face of the first contact member 192 in the rotation-axis direction, and an oblique face 192B, which inclines with respect to the rotation-axis direction. The pressing face 192A is a face to be pressed by the cam follower 170. The oblique face 192B may, when the slider member 64 is pressed by the cam follower 170 in the rotation-axis direction, contact the contact portion 94 on the left in the drawer 90 and urge the developing cartridge 60 in a direction parallel to the sheet-moving direction to move the developing cartridge 60 (see FIG. 4B). The oblique face 192B inclines, as the oblique face 192B extends from the one end toward the other end, e.g., from left to right, to be closer to a side of the developing roller 61 with respect to the corresponding photosensitive drum 50 along the second direction. In other words, a leftward part of the oblique face 192B is closer to the rear, and a rightward part of the oblique face 192B is closer to the front.

The second contact member 193 includes an oblique face 193B, which inclines similarly to the oblique face 192B of the first contact member 192. The oblique face 193B may, when the slider member 64 is pressed by the cam follower 170 in the rotation-axis direction, contact the contact portion 94 on the right in the drawer 90 and urge the developing cartridge 60 in the direction parallel to the sheet-moving direction to move the developing cartridge 60 (see FIG. 4B), in the same manner as the oblique face 192B.

At a position between the first contact member 192 and the case 63, arranged is a spring 194, which urges the slider member 64 toward one side, e.g., leftward, in the rotation-axis direction. The spring 194 may be a compressed coil spring arranged to coil around an outer periphery of the shaft 191.

Figure 5:
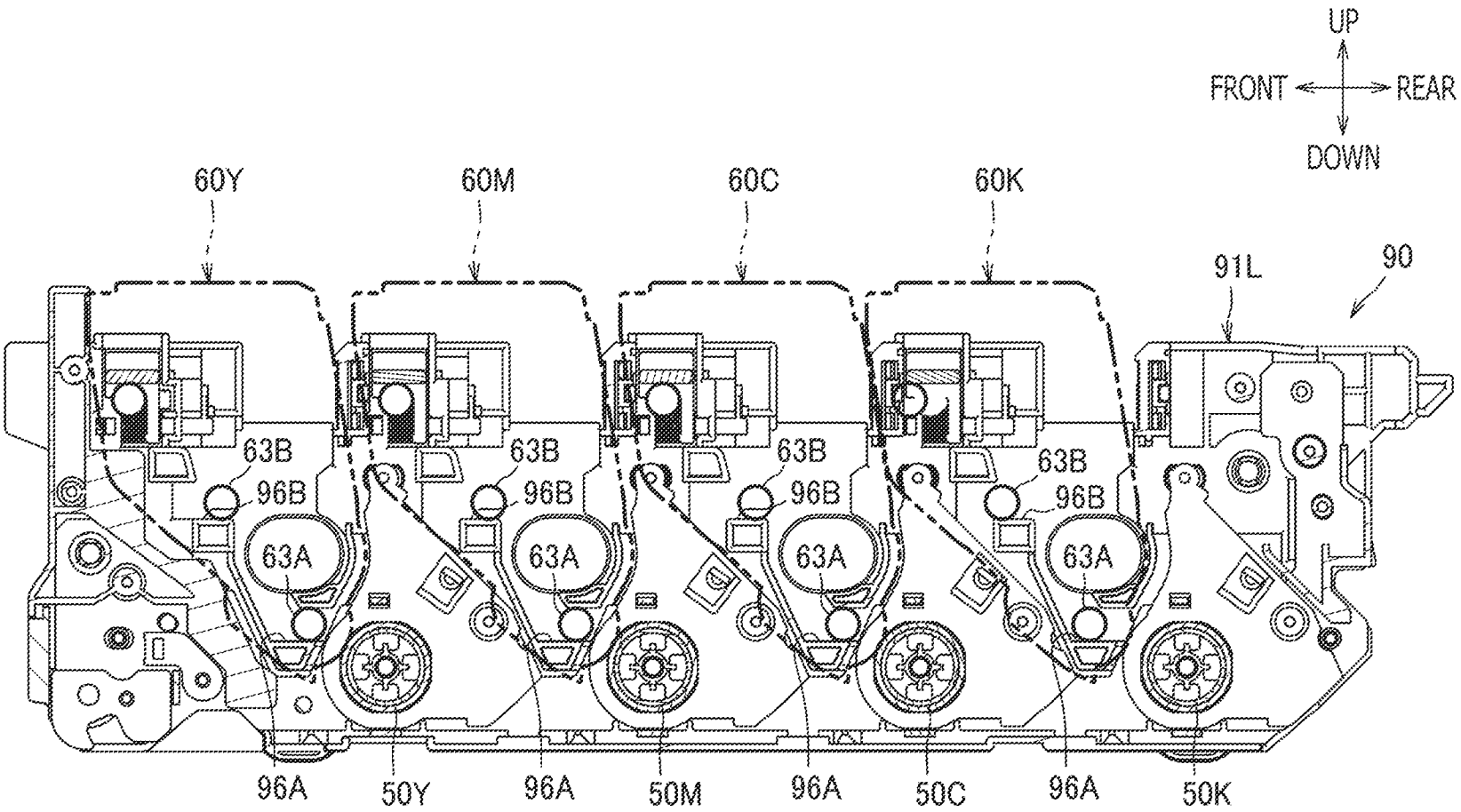
FIG. 5 is an inner-side view of a side frame in the drawer in the image forming apparatus according to the embodiment of the present disclosure.

As shown in FIG. 5, the drawer 90 has a first supporting face 96A and a second supporting face 96B on an inner side of the side frame 91L on the left. The first supporting face 96A and the second supporting face 96B may support the first protrusive portion 63A and the second protrusive portion 63B of the case 63, respectively, from below when the developing roller 61 moves from the contacting position to the separated position. The first supporting face 96A and the second supporting face 96B extend in the sheet-moving direction. The first supporting face 96A is arranged to support the first protrusive portion 63A. The first supporting face 96A may guide the developing roller 61 and locate the developing roller 61 at a predetermined vertical position when the developing cartridge 60 is being attached to the drawer 90. The second supporting face 96B is arranged to support the second protrusive portion 63B at an upper position with respect to the first supporting face 96A. Although not shown in the drawings, the drawer 90 has a first supporting face and a second supporting face, which are in symmetrical forms as the first supporting face 96A and the second supporting face 96B, respectively, at positions on an inner side of the side of the side frame 91R on the right.

When the developing roller 61 is located at the contacting position, in which the developing roller 61 contacts the corresponding photosensitive drum 50, as seen in the first developing cartridge 60Y, the second developing cartridge 60M, and the third developing cartridge 60C shown in FIG. 5, the first protrusive portion 63A is located at a rearward position on the first supporting face 96A. On the other hand, when the developing roller 61 is located at the separated position, in which the developing roller 61 is separated from the corresponding photosensitive drum 50, as seen in the fourth developing cartridge 60K, the first protrusive portion 63A is located at a frontward position on the first supporting face 96A. Thus, when the developing roller 61 is moved from the contacting position to the separated position, the moving mechanism may move the developing roller 61 in a direction from a position on a downstream side to a position on an upstream side along the sheet-moving direction.

Figure 18A:
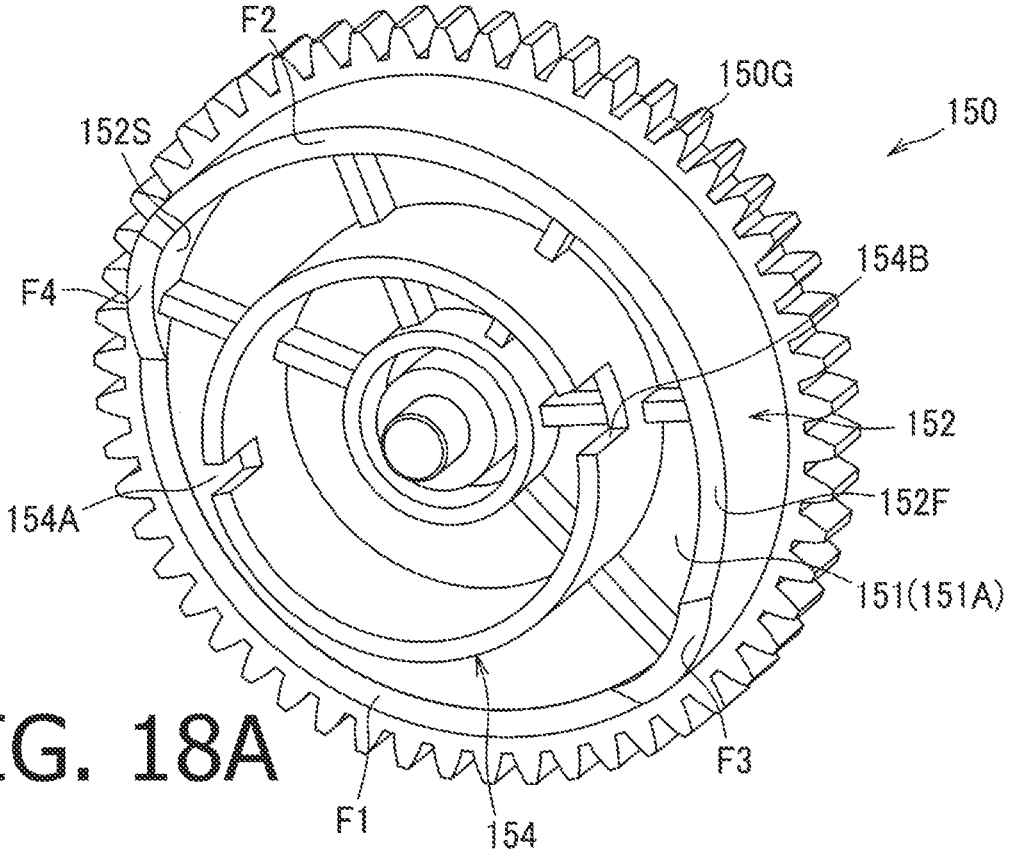
FIGS. 18A and 18B are perspective views of a cam for yellow, magenta, or cyan viewed from a first side and a second side, respectively, in the image forming apparatus according to the embodiment of the present disclosure.
Figure 18B:
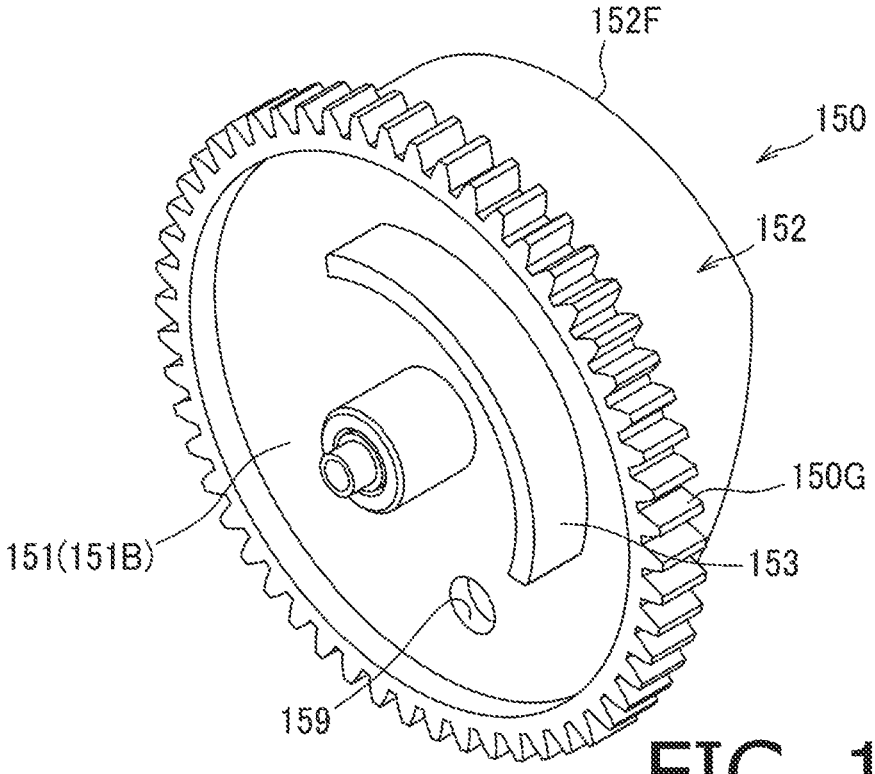

As shown in FIGS. 18A-18B, the cam 150 includes a disc portion 151, a gear portion 1506, the first cam portion 152, a second cam portion 153, and a phase-detector wall 154. The cam 150 may move the corresponding developing roller 61 between the contacting position and the separated position by rotating.

The disc portion 151 has an approximate shape of a disc and is rotatably supported by a supporting plate 102 (see FIG. 7). The disc portion 151 has a positioning hole 159 formed through the disc portion 151 in the axial direction. The positioning hole 159 is a hole, in which a pin of an assembling tool (not shown) may be inserted when the cam 150 is being attached to the supporting plate 102 so that the cam 150 may be attached to the supporting plate 102 easily in a posture corresponding to a predetermined phase. In other words, the assembling tool may have four (4) pins, each of which may be inserted in the positioning hole 159 of each cam 150, so that the cam 150 may be supported by the supporting plate 102 in predetermined posture. The gear portion 150G is formed on an outer circumference of the disc portion 151. The first cam portion 152 is an edge cam to move the developing roller 61 and protrudes in the rotation-axis direction from a first face 151A, which is on one side of the disc portion 151. The first cam portion 152 extends in a circumferential direction centered at the rotation axis of the cam 150. The first cam portion 152 includes a cam face 152F at the end in the rotation-axis direction thereof. The cam face 152F includes a first retainer face F1, a second retainer face F2, a first guide face F3, and a second guide face F4. The first retainer face F1 may retain the cam follower 170 at the standby position. The second retainer face F2 may retain the cam follower 170 at the protrusive position. The first guide face F3 connects the first retainer face F1 with the second retainer face F2 and inclines with respect to the first retainer face F1. The second guide face F4 connects the second retainer face F2 with the first retainer face F1 and inclines with respect to the first retainer face F1. The second retainer face F2 is indicated by dot-hatching in the first cam portion 152 shown in FIGS. 10A-10B and 19B-24B.

The second cam portion 153 works in conjunction with a lever 160 to manipulate the clutch 120 to switch transmission and disconnection through the clutch 120. The second cam portion 153 is a leaf cam protruding sideward along the rotation-axis direction from a second face 151B, which is on the other side of the disc portion 151 opposite to the first face 151A. The second cam portion 153 protrudes sideward from a side face opposite to the side face, on which the first cam portion 152 is arranged. The second cam portion 153 extends in an arc in a view along the rotation-axis direction. The second cam portion 153 may be formed integrally with the disc portion 151. Therefore, the second cam portion 153 rotates synchronously with the first cam portion 152.

The phase-detector wall 154 is a wall, extending in a circumferential direction centered at the rotation axis of the cam 150, to block light emitted from light-emitters in separation sensor 4C or 4K (see FIG. 7). The phase-detecting wall 154 protrudes in the axial direction from the first face 151A of the disc portion 151 at a position closer than the first cam portion 152 to the rotation axis. In other words, the phase-detector wall 154 protrudes from the same side of the disc portion 151 as the side, on which the first cam portion 152 is arranged. The phase-detector wall 154 is arranged on an inner side with respect to an inner circumferential face 152S of the first cam portion 152. The phase-detector wall 154 has a first slit 154A and a second slit 154B to indicate rotational phases of the cam 150. The first slit 154A in the cam 150Y may allow the light from the light emitter of the separation sensor 4C to transmit there-through when the third developing roller 61C is at the separated position. The first slit 154A in the cam 150K may allow the light from the light emitter of the separation sensor 4K to transmit there-through when the fourth developing roller 61K is at the separated position. The second slit 154B in the cam 150C may allow the light from the light emitter in the separation sensor 4C to transmit there-through when the third developing roller 61C is at the contacting position. The second slit 154B in the cam 150K may allow the light from the light emitter in the separation sensor 4K to transmit there-through when the fourth developing roller 61K is at the contacting position. The second slit 154B has a different size in the circumferential direction from a size of the first slit 154A. In particular, the size of the second slit 154B in the circumferential direction is larger than the size of the first slit 154A in the circumferential direction. In each of the cams 150Y, 150M, 150C corresponding to yellow, cyan, and magenta, respectively, the first slit 154A and the second slit 154B are located at substantially opposite positions across the rotation axis of each the cams 150Y, 150M, 150C. In the meantime, in the cam 150K corresponding to black, the first slit 154A and the second slit 154B are separated for approximately 90 degrees from each other (see FIG. 7). In other words, the cam 150K has two (2) first slits 154A and two (2) second slits 154B, which are arranged alternately at intervals of approximately 90 degrees.

Figure 19A:
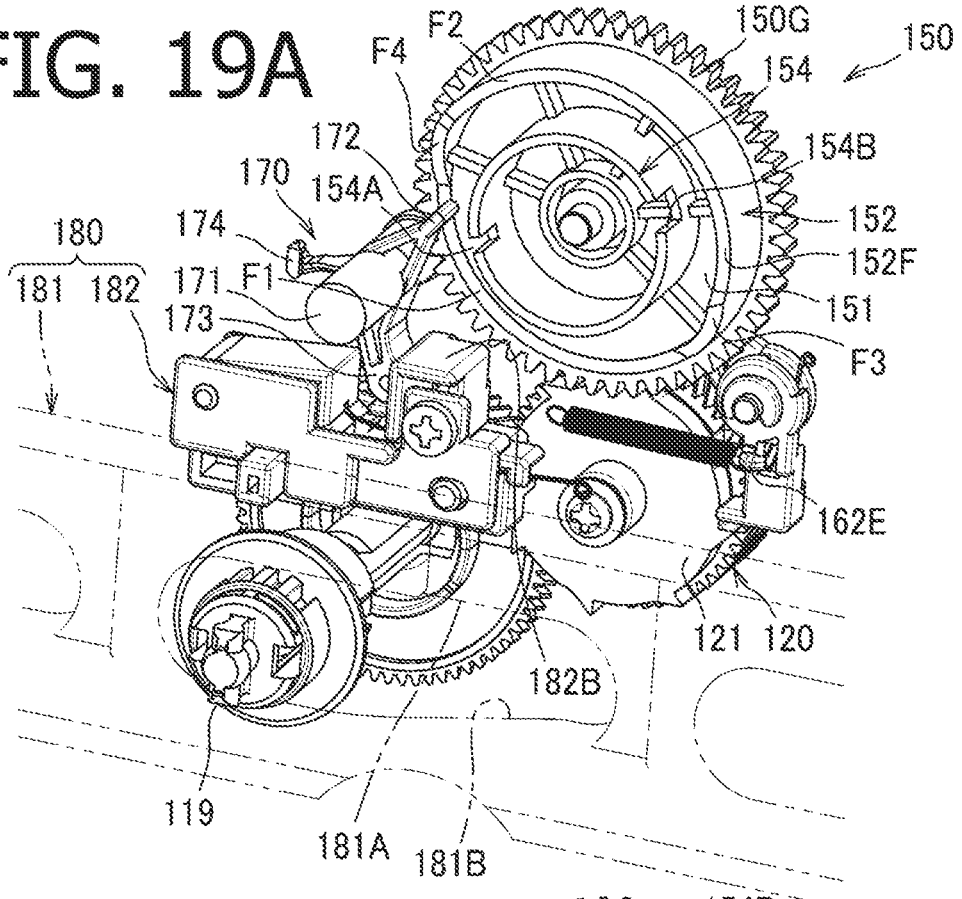
FIGS. 19A and 19B are a perspective view and a side view, respectively, of the cam, the cam follower, and the releasing member in the image forming apparatus according to the embodiment of the present disclosure, when the cam rotates in a normal direction and the developing roller is at a contacting position.
Figure 19B:
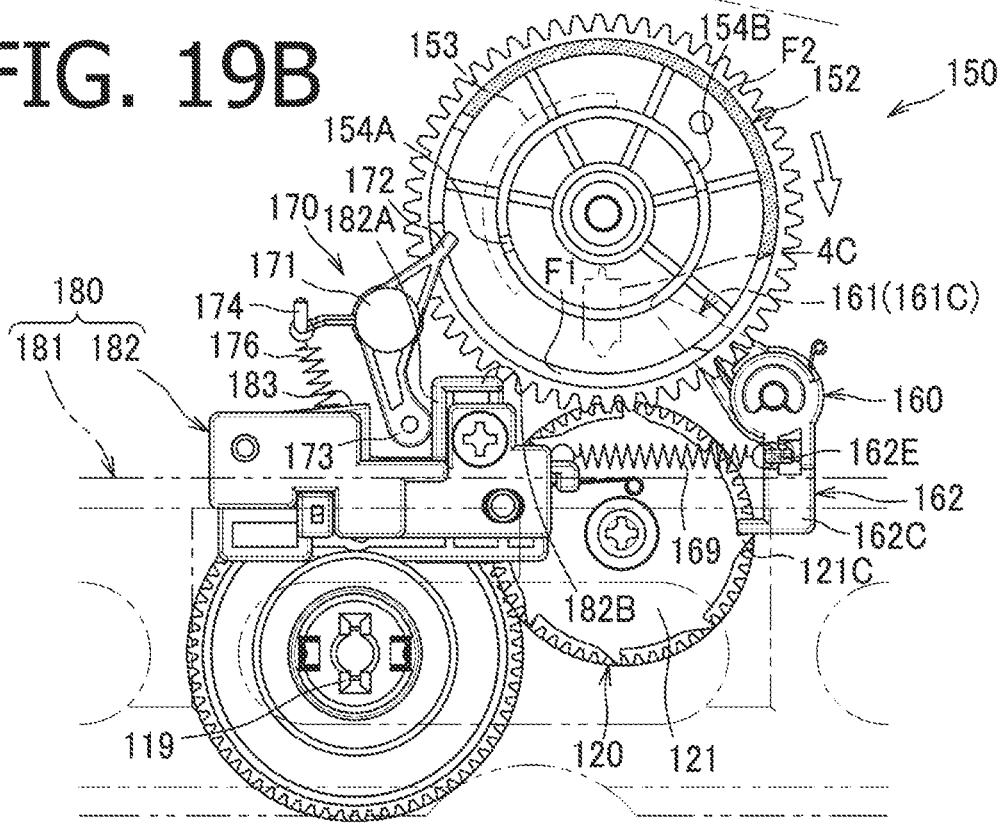

As shown in FIGS. 19A-19B, the cam follower 170 includes a slidable shaft 171, a contact portion 172, an arm 173, and a spring hook 174. The slidable shaft 171 is slidably supported by the supporting shaft 179, which is fixed to the casing 10, to slide in the rotation-axis direction. The contact portion 172 extends from the slidable shaft 171. An end face of the contact portion 172 at one end in the rotation-axis direction faces the cam face 152F of the first cam portion 152 and may contact the cam face 152E The arm 173 extends in a direction to be away from the supporting shaft 179 and the slidable shaft 171. The arm 173 extends from the slidable shaft 171 in a direction different from an extending direction of the contact portion 172. For example, the arm 173 may extend downward from the slidable shaft 171. The spring hook 174 extends in a direction to be away from the slidable shaft 171. For example, the spring shaft 174 may extend frontward.

The first spring 176 may be a contractive spring, and one end of the first spring 176 is hooked to the spring hook 174. The other end of the first spring 176 is hooked to the supporting plate 102 at a position lower than the spring hook 174. Thus, the first spring 176 may urge the cam follower 170 toward the supporting plate 102, in other words, in a direction from the protrusive position toward the standby position. The first spring 176 may, moreover, urge the cam follower 170 counterclockwise in FIGS. 19A-19B, in other words, in a direction from the inoperable position toward the operable position.

As shown in FIG. 7, the cams 150Y, 150M, 150C are in substantially a same configuration except that a circumferential length of the first cam portion 152 along a rotating direction is greater in the cam 150Y alone than a circumferential length of the other first cam portion 152 in the cams 150M, 150C. Meanwhile, the cam 150K for black has two (2) first cam portions 152, which are shorter in the rotational direction than the first cam portions 152 of the cams 150Y, 150M, 150C. In the casing 10, arranged are separation sensors 4C, 4K for cyan and black.

The separation sensors 4C, 4K are phase sensors detectable of phases of the cams 150C, 150 K, respectively. The separation sensors 4C, 4K each include a photo-interrupter having a light-emitter and a light-receiver. When the first slit 154A or the second slit 154B of the separation sensor 4C/4K is located at a position between the light-emitter and the light-receiver, and when the light emitted from the light-emitter is received by the light-receiver, the separation sensor 4C/4K may output an ON signal to the controller 2. While the phase-detector wall 154 is between the light-emitter and the light-receiver to block the light from the light-emitter, the separation sensor 4C/4K may output an OFF signal to the controller 2.

The first slit 154A and the second slit 154B described earlier may allow the light emitted from the light emitter in the separation sensor 4C/4K to pass there-through when the developing roller 61 is at the separated position and the contacting position, respectively. Therefore, the separation sensor 4C may output the ON signal to the controller 2 when the third developing roller 61C is at the separated position and the light from the light-emitter passing through the first slit 154A is received by the light-receiver. The separation sensor 4K may output the ON signal to the controller 2 when the fourth developing roller 61K is at the separated position and the light from the light-emitter passing through the first slit 154A is received by the light-receiver. Moreover, the separation sensor 4C may out put the ON signal to the controller 2 when the third developing roller 61C is at the contacting position and the light from the light-emitter passing through the second slit 154B is received by the light-receiver. The separation sensor 4K may out put the ON signal to the controller 2 when the fourth developing roller 61K is at the contacting position and the light from the light-emitter passing through the second slit 154B is received by the light-receiver. In other words, each separation sensor 4C/4K is located at a position, in which the separation sensor 4C/4K may detect the first slit 154A when the third/fourth developing roller 61C/61K is at the separated position and may detect the second slit 154B when the third/fourth developing roller 61C/61K is at the contacting position.

In the present embodiment, for a reason of convenience, a condition, in which the light-receiver(s) in the separation sensor(s) 4C, 4K is/are receiving the light, may be expressed as "the separation sensor(s) 4C, 4K is/are ON." On the other hand, a condition, in which the light-receiver(s) in the separation sensor(s) 4C, 4K are not receiving the light, may be expressed as "the separation sensor(s) 4C, 4K is/are OFF. A voltage required in the phase sensors 4C, 4K to output the ON signal may either be higher or lower than a voltage in the phase sensors 4C, 4K not outputting the ON signal. It may be noted that the cams 150Y, 150M as well has the same formation as the phase-detector wall 154; however, neither the cam 150Y nor the cam 150M is provided with a separation sensor.

Referring back to FIG. 1, the conveyer 70 is arranged between the sheet tray 21 and the photosensitive drum 50. The conveyer 70 includes a driving roller 71, a driven roller 72, a conveyer belt 73 being an endless belt, and four (4) transfer rollers 74. The conveyer belt 73 is strained around the driving roller 71 and the driven roller 72, with an upper outer surface thereof facing the photosensitive drum 50. The transfer rollers 74 are arranged inside the conveyer belt 73 to nip the conveyer belt 73 in cooperation with the first, second, third, and fourth photosensitive drums 50Y, 50M, 50C, 50K. The conveyer 70 may convey the sheet S placed on the upper outer surface thereof by moving the conveyer belt 73 so that the toner images on the first, second, third, and fourth photosensitive drums 50Y, 50M, 50C, 50K may be transferred onto the sheet S.

The fuser 80 is arranged at a rearward position with respect to the photosensitive drum 50 and the conveyer 70. The fuser 80 includes a heat roller 81 and a pressurizer roller 82 arranged to face the heat roller 81. At an upper position with respect to the fuser 80, arranged is a conveyer roller 15, and at an upper position with respect to the conveyer roller 15, arranged is an ejection roller 16.

In the image forming device 30 configured as above, the surface of the photosensitive drum 50 may be charged evenly by the charger and selectively exposed to the light emitted from the exposure device 40. Thereby, electrostatic latent images based on image data may be formed on the surface of the photosensitive drum 50.

Meanwhile, the toner in the case 63 may be supplied to the surface of the developing roller 61, and when the developing roller 61 contacts the corresponding photosensitive drum 50, the toner may be supplied to the electrostatic latent image formed on the surface of the photosensitive drum 50. Thus, the toner image may be formed on the photosensitive drum 50.

When the sheet S on the conveyer belt 73 passes through the position between the photosensitive drum 50 and the transfer roller 74, the toner image formed on the photosensitive drum 50 may be transferred onto the sheet S. Further, as the sheet S is conveyed to pass through the position between the heat roller 81 and the pressurizer roller 82, the toner images transferred to the sheet S may be fused to the sheet S.

The sheet S ejected from the fuser 80 may be conveyed by the conveyer roller 15 and the ejection roller 16 to rest on an ejection tray 13 formed on an upper face of the casing 10.

Next, described in the following paragraphs will be a configuration to drive or stop rotation of the developing roller 61 and a configuration to move the developing roller 61 to contact or separate from the photosensitive drum 50.

Figure 6:
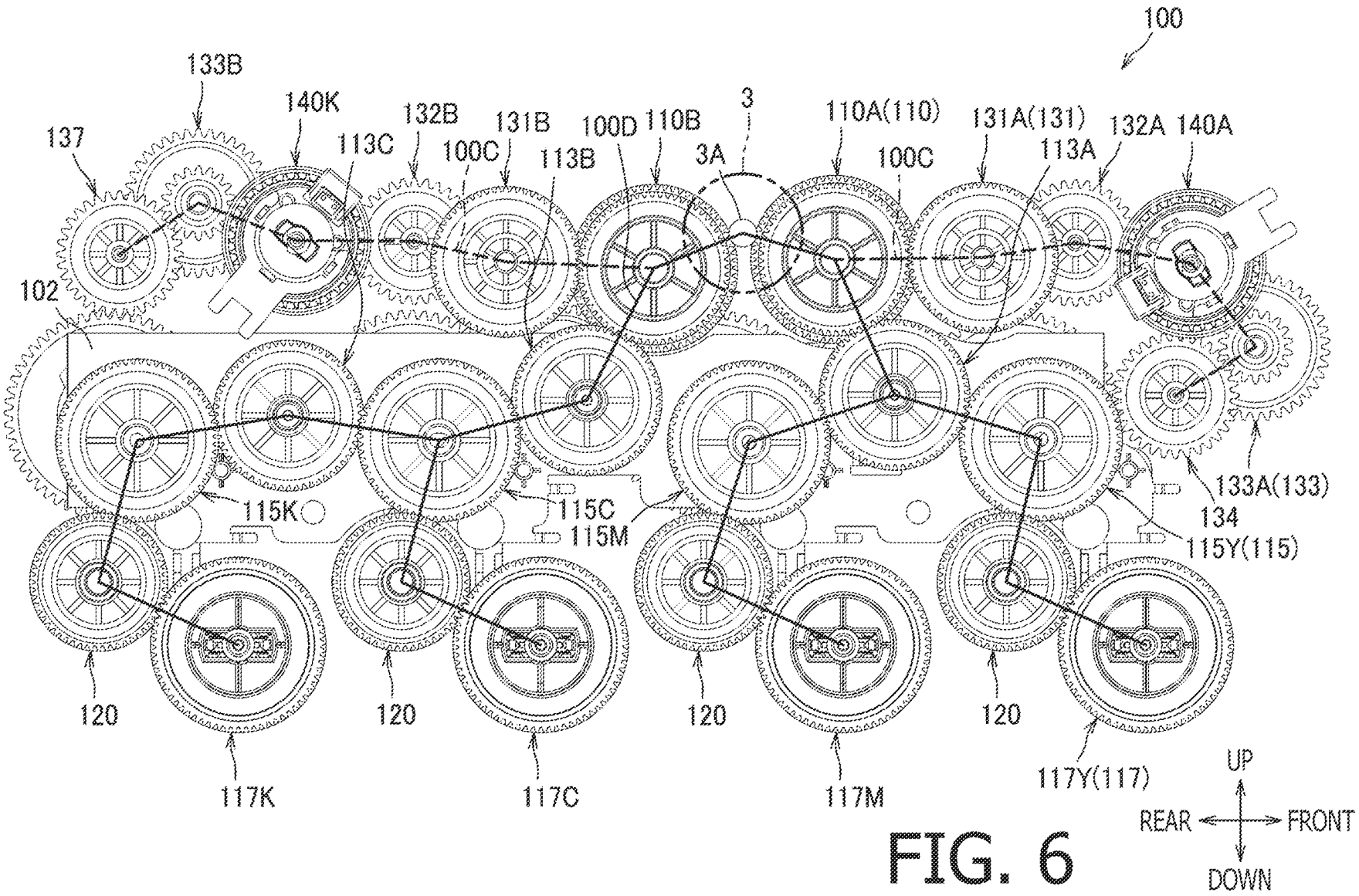
FIG. 6 is a side view of a driving-force transmitter in the image forming apparatus according to the embodiment of the present disclosure viewed from left toward right along an axial direction.

As shown in FIG. 6, the image forming apparatus 1 includes a motor 3, which may drive the developing roller 61, and a driving-force transmitter 100, which may transmit a driving force from the motor 3 to the developing roller 61. The cam 150 being a part of the moving mechanism is mechanically connected with the driving-force transmitter 100. The driving-force transmitter 100 is arranged not to transmit the driving force to the developing roller 61 when the developing roller 61 is at the separated position.

The motor 3 is a driving source to drive the developing roller 61 and the cam 150. The motor 3 may rotate in either a normal direction or a reverse direction. The controller 2 may control rotation of the motor 3.

Figure 8:
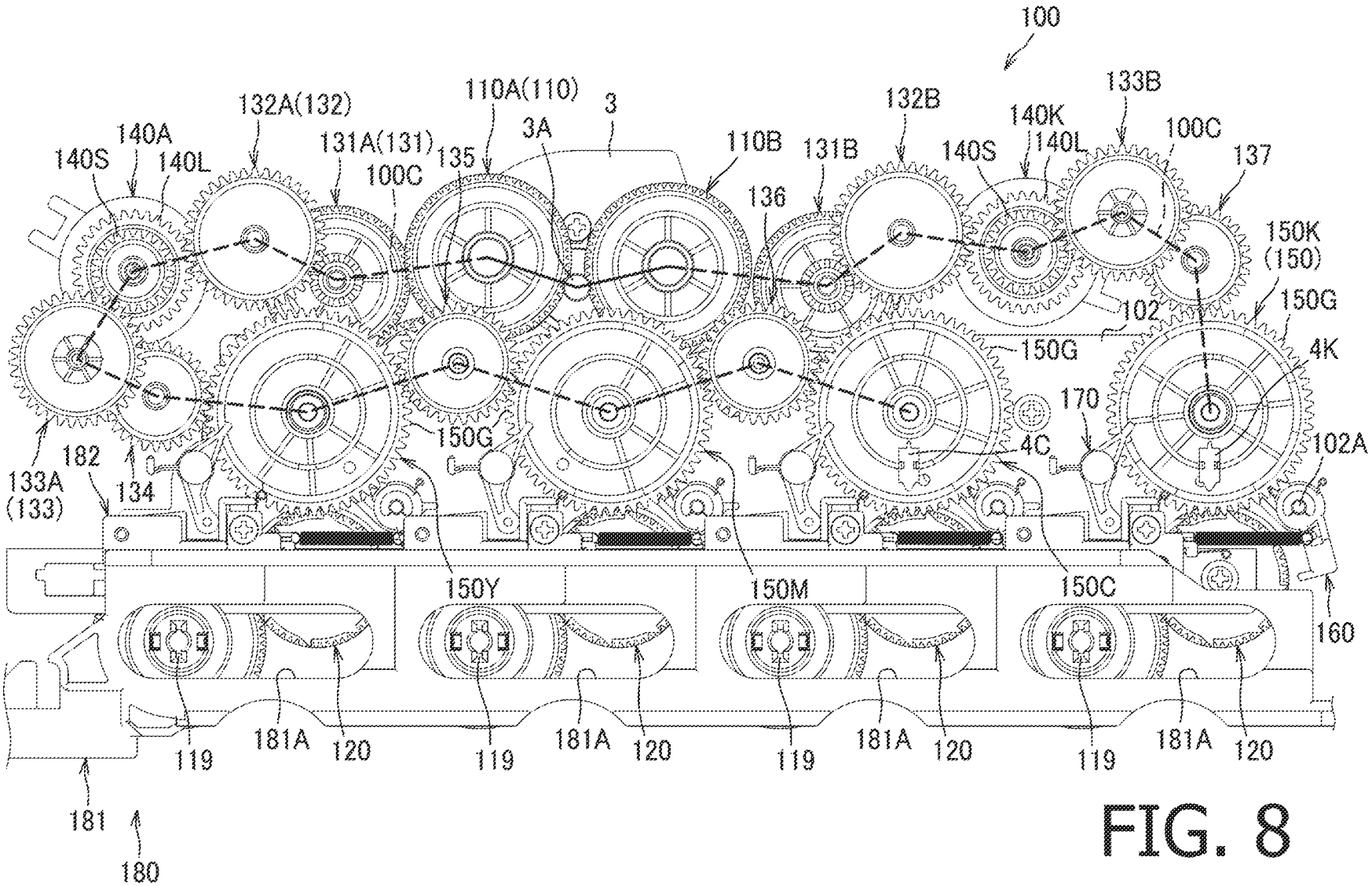
FIG. 8 is a side view of the driving-force transmitter in the image forming apparatus according to the embodiment of the present disclosure viewed from right toward left along the axial direction.

The driving-force transmitter 100 includes, as shown in FIG. 6, a driving-force transmitter gear train 100D, which may transmit the driving force from the motor 3 to the developing roller 61, and is mechanically connected with a driving-force controlling gear train 100C, which may control transmission of the driving force from the driving-force transmitter gear train 100D. The driving-force controlling gear train 100C may transmit the driving force from the motor 3 to the cam 150. The driving-force controlling gear train 100C may rotate the cam 150 in a normal direction when the motor 3 rotates in the normal direction and may rotate the cam 150 in a reverse direction when the motor 3 rotates in the reverse direction. In FIGS. 6 and 8, intermeshing transmitting flows through gears in the driving-force transmitter gear train 100D are indicated in thicker solid lines, and intermeshing transmitting flows through gears in the driving-force controlling gear train 100C are indicated in thicker broken lines.

The driving-force transmitter gear train 100D includes first idle gears 110, three (3) second idle gears 113A, 113B, 113C, third idle gears 115, clutches 120, and coupling gears 117. The first idle gears 100 include two (2) first idle gears 110A, 110B; the third idle gears 115 include four (4) third idle gears 115Y, 115M, 115C, 115K; the clutches 120 includes four (4) clutches 120; and the coupling gears 117 include four (4) coupling gears 117Y, 117M, 117C, 117K. The gears forming the driving-force transmitter gear train 100D are supported by either the supporting plate 102 or a frame, which is not shown, and may rotate about rotation axes parallel to the rotation axis of the photosensitive drum 50.

The motor 3 includes an output shaft 3A, which may rotate when the motor 3 is active. To the output shaft 3A, attached is a gear, which is not shown.

The third idle gears 115Y, 115M, 115C, 115K are provided to correspond to the colors of yellow, magenta, cyan, and black, respectively, and arranged in this recited order from front to rear. In other words, the third idle gear 115Y for yellow is at a most frontward position among the third idle gears 115Y, 115M, 115C, 115K, and the third idle gear 115K for black is at a most rearward position among the third idle gears 115Y, 115M, 115C, 115K.

The clutches 120 are in a same configuration. The clutches 120 each meshes with one of the third idle gears 115Y, 115M, 115C, 115K to receive the driving force from the third idle gears 115Y, 115M, 115C, 115K. The clutches 120 will be described further below.

The coupling gears 117 each meshes with one of the clutches 120. Each coupling gear 117 includes a coupling shaft 119 (see FIG. 7), which is rotatable integrally with the coupling gear 117. The coupling shaft 119 is movable in a direction of an axis thereof in cooperation with opening/closing motions of the cover 11. The coupling shaft 119 may engage with a coupling 65 (see FIG. 3A) in the developing cartridge 60 when the cover 11 is closed.

With the driving-force transmitter gear train 100D, the coupling gear 117Y for yellow may receive the driving force from the motor 3 through the first idle gear 110A, the second idle gear 113A, the third idle gear 115Y, and the clutch 120. The coupling gear 117M for magenta may receive the driving force from the motor 3 through the first idle gear 110A, the second idle gear 113A, the third idle gear 115M, and the clutch 120. The coupling gear 117C for cyan may receive the driving force from the motor 3 through the first idle gear 110B, the second idle gear 113B, the third idle gear 115C, and the clutch 120. The coupling gear 117K for black may receive the driving force from the motor 3 through the first idle gear 110B, the second idle gear 113B, the third idle gear 115C, the second idle gear 113C, the third idle gear 115K, and the clutch 120.

As shown in FIGS. 7 and 8, the driving-force controller gear train 100C includes fourth idle gears 131, fifth idle gears 132, a YMC clutch 140A, a K clutch 140K, sixth idle gears 133, a seventh idle gear 134, an eighth idle gear 135, a ninth idle gear 136, a tenth idle gear 137, and the cam 150 including the cams 150Y, 150M, 150C, 150K described earlier. The fourth idle gears 131 include two (2) fourth idle gears 131A, 131B; the fifth idle gears 132 include two (2) fifth idle gears 132A, 132B; the sixth idle gears 133 include two (2) idle gears 133A, 133B. The gears forming the driving-force controller gear train 100C are supported by either the supporting plate 102 or a frame, which is not shown, and may rotate about rotation axes parallel to the rotation axis of the photosensitive drum 50.

The fifth idle gear 132A is arranged at a frontward position with respect to the fourth idle gear 131A, and the fifth idle gear 132B is arranged at a rearward position with respect to the fourth idle gear 131B. The fifth idle gears 132A, 132B mesh with the fourth idle gears 131A, 131B, respectively.

The YMC clutch 140A may switch transmission and disconnection of the driving-force controller gear train 100C, which forms the transmission flow to transmit the driving force from the motor 3 to the cams 150Y, 150M, 150C. In other words, the YMC clutch 140A may switch state of the cams 150Y, 150M, 150C between rotating and stationary. The YMC clutch 140A includes a larger-diameter gear 140L and a smaller-diameter gear 140S. A quantity of teeth in the smaller-diameter gear 140S is smaller than a quantity of teeth in the larger-diameter gear 140L. The YMC clutch 140A is arranged at a frontward position with respect to the fifth idle gear 132A, with the larger-diameter gear 140L meshing with the fifth idle gear 132A. The YMC clutch 140A may be, for example, an electromagnetic clutch, in which the larger-diameter gear 140L and the smaller-diameter gear 140S may rotate integrally when the YMC clutch 140A is powered on, or activated; and when the YMC clutch 140A is powered off, or deactivated, the larger-diameter gear 140L may idle so that the smaller-diameter gear 140S may stay stationary.

The K clutch 140K is in the configuration similar to the YMC clutch 140A. Therefore, the K clutch 140K may switch transmission and disconnection of the driving-force controller gear train 100C, which forms the transmission flow to transmit the driving force from the motor 3 to the cam 150K. In other words, the K clutch 140K may switch state of the cam 150K between rotating and stationary. The K clutch 140K includes a larger-diameter gear 140L and a smaller-diameter gear 140S. A quantity of teeth in the smaller-diameter gear 140S is smaller than a quantity of teeth in the larger-diameter gear 140L. The K clutch 140A is arranged at a rearward position with respect to the fifth idle gear 132B, with the larger-diameter gear 140L meshing with the fifth idle gear 132B.

The sixth idle gear 133A is arranged at a frontward position with respect to the YMC clutch 140A, and the sixth idle gear 133B is arranged at a rearward position with respect to the K clutch 140K. The sixth idle gears 133A, 133B mesh with the smaller-diameter gears 140S in the YMC clutch 140A and the K clutch 140K, respectively.

The seventh idle gear 134 is arranged between the sixth idle gear 133A and the cam 150Y. The seventh idle gear 134 meshes with the sixth idle gear 133A and the gear portion 150G in the cam 150Y.

The eighth idle gear 135 is arranged between the cam 150Y and the cam 150M. The eighth idle gear 135 meshes with the gear portion 150G in the cam 150Y and the gear portion 150G in the cam 150M.

The ninth idle gear 136 is arranged between the cam 150M and the cam 150C. The ninth idle gear 136 meshes with the gear portion 150G in the cam 150M and the gear portion 150G in the cam 150C.

The tenth idle gear 137 is arranged between the sixth idle gear 133B and the cam 150K. The tenth idle gear 137 meshes with the sixth idle gear 133B and the gear portion 150G in the cam 150K.

With the driving-force controlling gear train 100C, the cam 150Y for yellow may receive the driving force from the motor 3 through the first idle gear 110A, the fourth idle gear 131A, the fifth idle gear 132A, the YMC clutch 140A, the sixth idle gear 133A, and the seventh idle gear 134. The cam 150M for magenta may receive the driving force from the cam 150Y for yellow through the eighth idle gear 135. The cam 150C for cyan may receive the driving force from the cam 150M for magenta through the ninth idle gear 136. The cams 150Y, 150M, 150C may synchronously rotate when the YMC clutch 140A is activated and stop rotating by when the YMC clutch 140A is deactivated.

The cam 150K for black, on the other hand, may receive the driving force from the motor 3 through the first idle gear 110B, the fourth idle gear 131B, the fifth idle gear 132B, the K clutch 140K, the sixth idle gear 133B, and the tenth idle gear 137. The cam 150K may rotate when the K clutch 150K is activated and stop rotating when the K clutch 140K is deactivated.

Next, the releasing member 180 will be described in detail below. The releasing member 180 as shown in FIG. 7 may move the coupling shaft 119 in the rotation-axis direction and the cam follower 170 from the operable position to the inoperable position in conjunction with the opening motion of the cover 11.

Figure 9A:
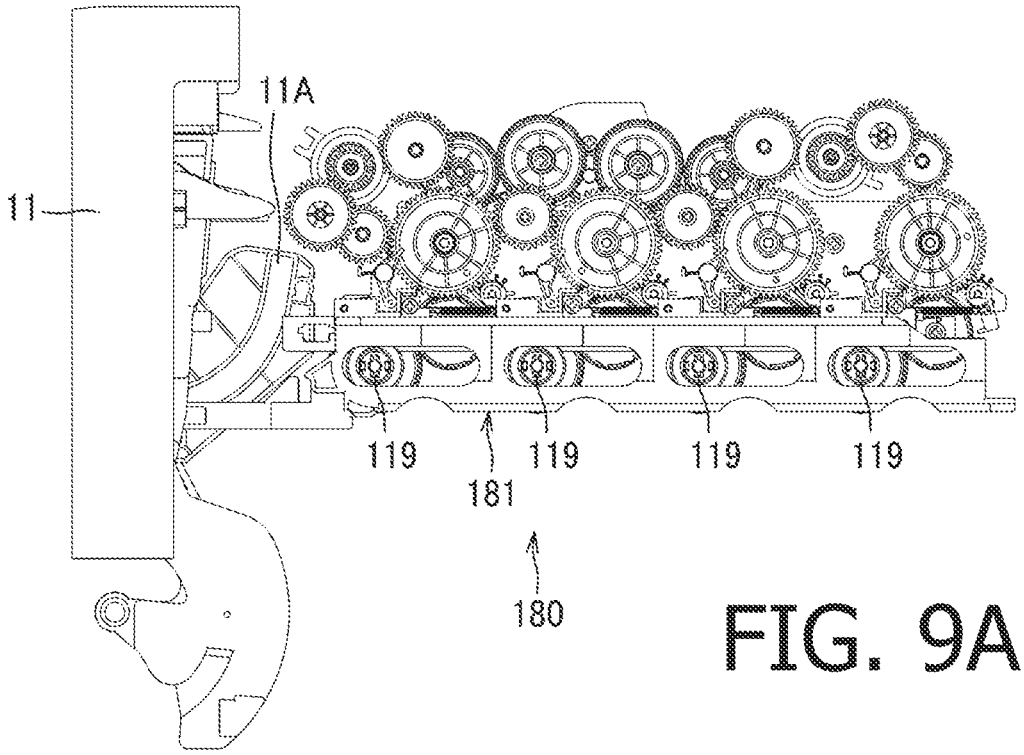
FIG. 9A is a side view of a releasing member in the image forming apparatus according to the embodiment of the present disclosure when a cover is at a closed position.
Figure 9B:
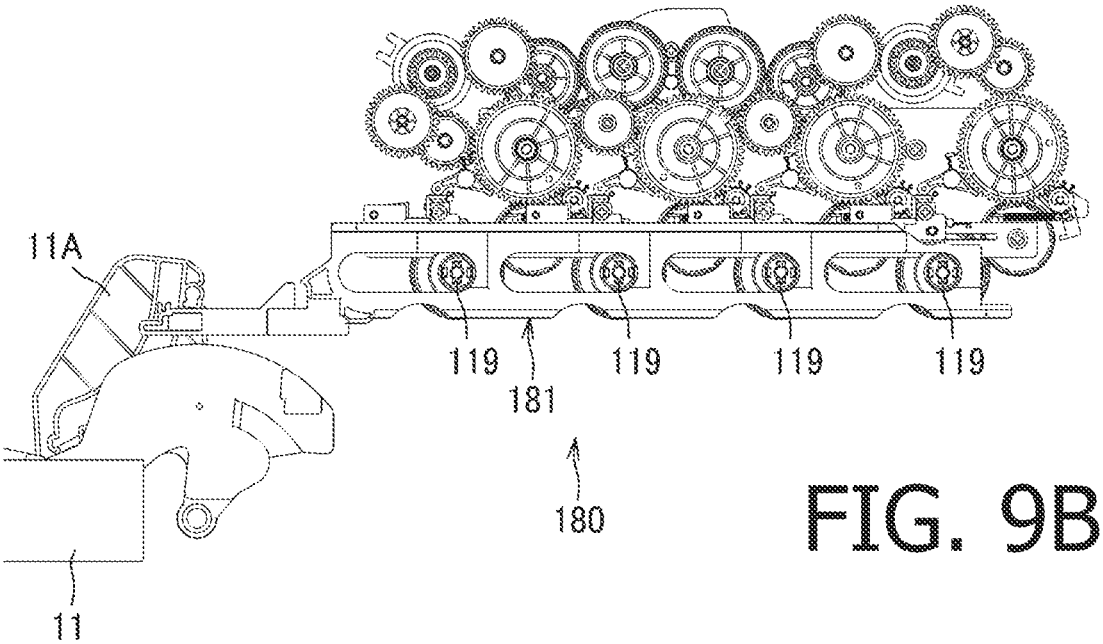
FIG. 9B is a side view of the releasing member in the image forming apparatus according to the embodiment of the present disclosure when the cover is at an open position.

As shown in FIG. 9A, the releasing member 180 is coupled to the cover 11 through a link 11A. When the cover 11 moves from the closed position as shown in FIG. 9A to the open position as shown in FIG. 9B, the releasing member 180 may move frontward linearly. In other words, the releasing member 180 may move in conjunction with the opening and closing motions of the cover 11.

Referring back to FIG. 7, each releasing member 180 includes a coupling-movable member 181, which may move the coupling shaft 119, and a cam follower-movable member 182, which may move the cam follower 170. Moreover, the image forming apparatus 1 has a stopper 183, which may move in conjunction with the linear motion of the releasing member 180 and may pivot with respect to the releasing member 180, and a stopper-urging spring 184(see FIGS. 10A-10B), which may urge the stopper 183. Although not shown in detail in the drawings, the coupling-movable member 181 is supported by the casing 10 to be linearly movable in the front-rear direction, in which the photosensitive drums 50 align.

The coupling-movable member 181 has a through-hole 181A and a coupling-withdrawable cam 181B, which correspond to one of the coupling shafts 119. The through hole 181A allows an end of the coupling shaft 119 to penetrate there-through to be engaged with the coupling 65. The coupling-withdrawable cam 181B has a face inclining with respect to the front-rear direction, which may cause the coupling shaft 119 to move in the rotation-axis direction so that the coupling shaft 119 may be detached from the coupling 65 when the releasing member 180 moves frontward.

The cam follower-movable member 182 includes four (4) cam follower-movable members 182, each of which corresponds to one of the cam followers 170. The cam follower-movable member 182 is fixed to the coupling-movable member 180 and may move linearly in the front-rear direction along with the coupling-movable member 181.

Figure 10A:
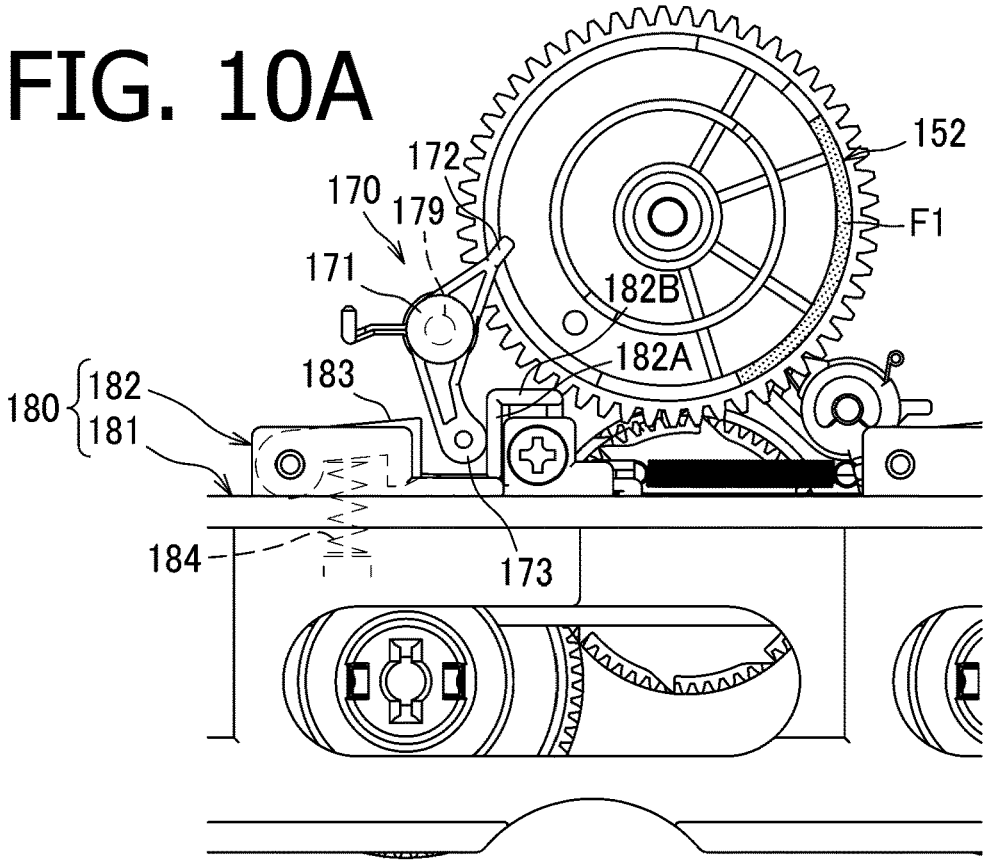
FIGS. 10A and 10B are illustrative views of a stopper in the image forming apparatus according to the embodiment of the present disclosure when the stopper is at a pivot-restrictive position, in which the stopper is not pushed by an arm, and when the stopper is at a pivot-allowable position, in which the stopper pushed by the arm pivots, respectively.
Figure 10B:
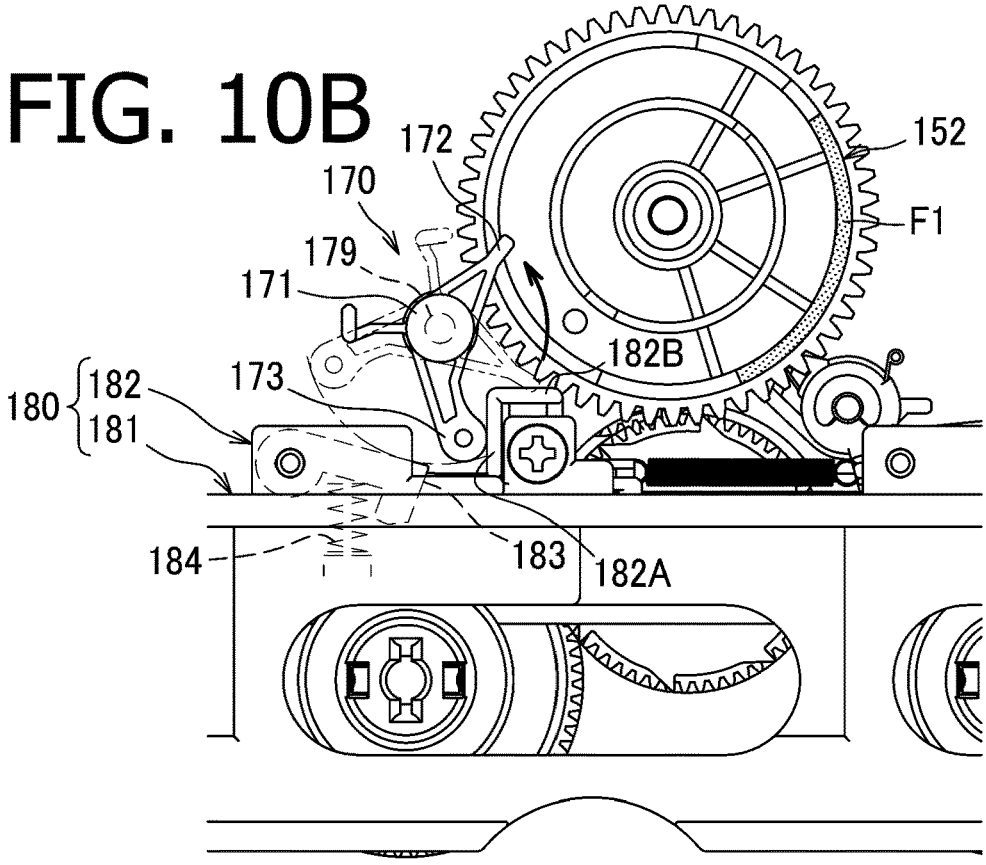

As shown in FIGS. 10A-10B, each cam-follower movable member 182 includes a release-engagement portion 182A and a cam-follower retainer 182B. The release-engagement portion 182A protrudes upward at a rearward position with respect to the arm 173 of the cam follower 170 being located at the operable position. Therefore, when the cover 11 moves from the closed position to the open position, and when the releasing member 180 linearly moves frontward, the release-engagement portion 182A may contact the arm 173 and move the cam follower 170 to pivot from the operable position to the inoperable position. Moreover, when the cover 11 is located at the closed position, and when the motor 3 rotates in the normal direction to cause the first cam portion 152 to guide the contacting portion 172, the release-engagement portion 182A may contact the arm 173 to restrict the cam follower 170 from pivoting about the supporting shaft 19.

The cam-follower retainer 182B extends rearward from an upper end of the release-engagement portion 182A. The cam-follower retainer 182B has an upward face, which may contact the arm 173 of the cam follower 170 to retain a posture of the cam follower 170 when the cover 11 moved from the closed position is located to the open position and the cam follower 170 is located at the inoperable position.

The stopper 183 is pivotably supported at a frontward portion thereof by the cam follower-movable member 182. In particular, the stopper 183 may pivot about an axis that extends in the rotation-axis direction and is pivotable upward and downward between a pivot-restrictive position, as shown in FIG. 10A, and a pivot-allowable position, as shown in FIG. 10B.

The stopper-urging spring 184 is arranged to urge the stopper 183 at all time in a direction from the pivot-restrictive position toward the pivot-allowable position. In FIGS. 10A-10B, the stopper-urging spring 184 is illustrated as a compressed spring located below the stopper 183; however, the stopper-urging spring 184 may not necessarily be limited to the compressed spring but may be, for example, a torsion spring. The stopper 183 is in such an arrangement that an upper face of the stopper 183 is located to be lower than the upward face of the cam-follower retainer 182B when the stopper 183 is at an uppermost position thereof.

The stopper 183 is arranged such that the arm 173 is located between the release-engagement portion 182A and the stopper 183 when the cover 11 moved from the open position is located at the closed position, and the cam follower 170 is located at the operable position (see FIG. 10A). In this arrangement, when the motor 3 rotates in the reverse direction and the cam 150 rotates in the reverse direction, the stopper 183 may contact the arm 173 and restrict the cam follower 170 from pivoting from the operable position to the inoperable position (see FIG. 23B). It may be noted that in the present embodiment the rotating direction of the motor 3, when the image forming apparatus 1 operates to form an image, may be called as the normal direction, and the rotating direction opposite to the normal direction may be called as the reverse direction. Moreover, rotation of the motor 3 in the normal direction may be called as normal rotation, and rotation of the motor 3 in the reverse direction may be called as reverse rotation.

On the other hand, when the cover 11 moved from the open position is located at the closed position, if the cam follower 170 is located at the inoperable position, the cam follower 170 may be moved by the contractive force of the first spring 176 toward the operable position, and the arm 173 may push the stopper 183 downward. Thereby, the stopper 183 may be moved to swing downward to allow the cam follower 170 to pivot to the operable position.

Figure 11A:
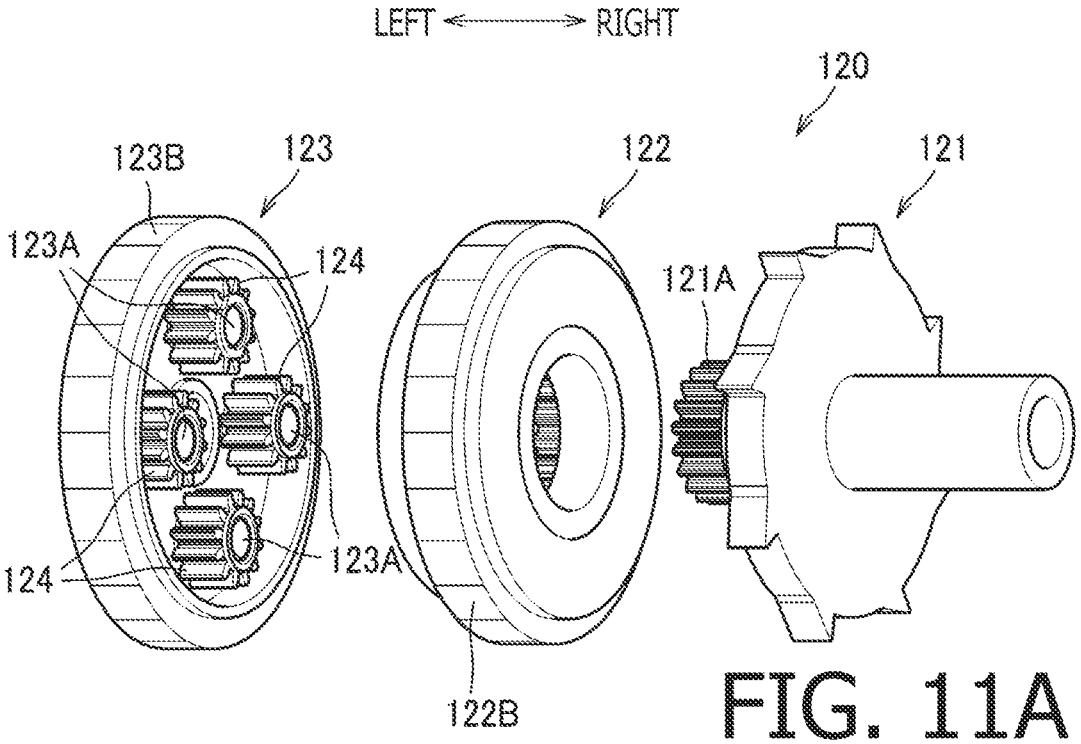
FIGS. 11A and 11B are exploded views of a clutch in the image forming apparatus according to the embodiment of the present disclosure, viewed from a side of a sun gear and a side of a carrier, respectively.
Figure 11B:
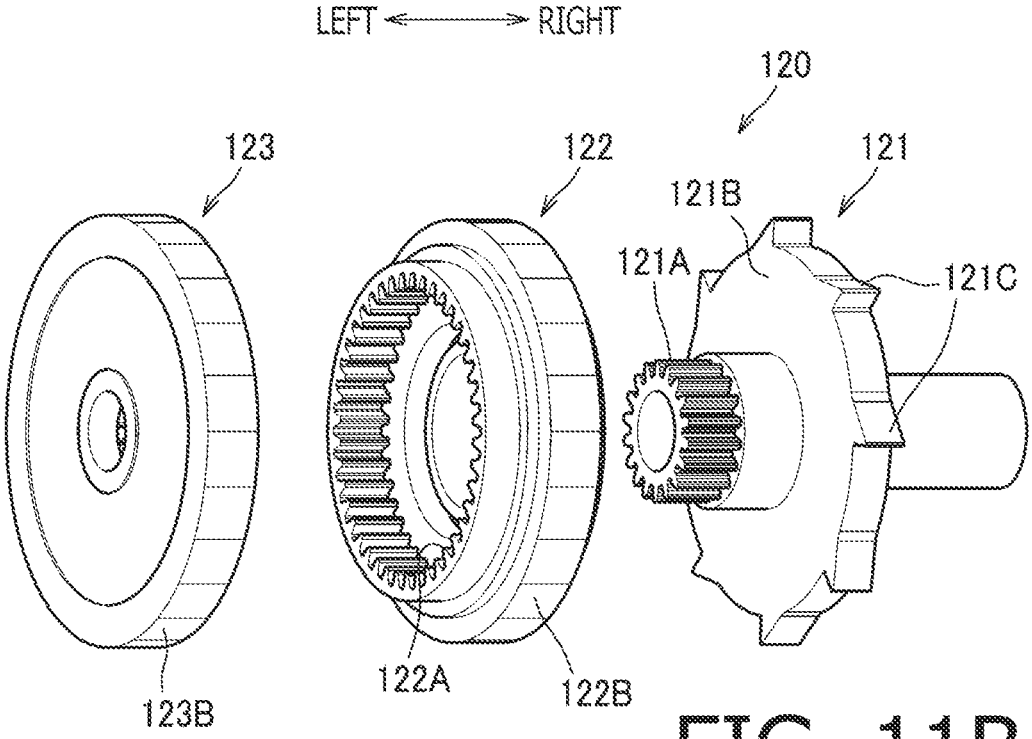

Next, in the following paragraphs, described will be the detailed configuration and movements of the clutch 120. As shown in FIGS. 11A-11B, each clutch 120 includes a planetary gear assembly. The clutch 120 is switchable between an engaging state, in which the clutch 120 engages transmission of the driving force from the motor 3 to the developing roller 61, and a disengaging state, in which the clutch 120 disengages transmission of the driving force from the motor 3 to the developing roller 61. The clutch 120 includes a sun gear 121, which is rotatable about an axis, a ring gear 122, a carrier 123, and planetary gears 124 supported by the carrier 123.

The sun gear 121 includes a disc portion 121B, which is rotatable integrally with the gear portion 121A, and claw portions 121C, which are arranged on an outer circumference of the disc portion 121. The claw portions 121C each has a pointed end, which leans to one side in a rotating direction of the sun gear 121. The ring gear 122 includes an inner gear 122A arranged on an inner circumferential surface and an input gear 122B arranged on an outer circumferential surface.

The carrier 123 includes four (4) shaft portions 123A, which support the planetary gears 124 rotatably. The carrier 123 includes an output gear 123B arranged on an outer circumferential surface thereof.

The planetary gears 124 include four (4) planetary gears 124, each of which is supported by one of the shaft portions 123A in the carrier 123. The planetary gears 124 mesh with gear portion 121A of the sun gear 121 and with the inner gear 122A in the ring gear 122.

In the clutch 120, the input gear 122B meshes with the third idle gear 115, and the output gear 123B meshes with the coupling gear 117 (see FIG. 6). In this arrangement, when the sun gear 121 is restrained from rotating, the clutch 120 is in the engaging state, in which the driving force input to the input gear 122B may be transmitted to the output gear 123B. On the other hand, when the sun gear 121 is allowed to rotate, the clutch 120 is in the disengaging state, in which the driving force input to the input gear 122B is not transmittable to the output gear 123B. When the clutch 120 is in the disengaging state, and the output gear 123B is under load, and when the driving force is input to the input gear 122B, the output gear 123B does not rotate so that the sun gear 121 idles.

As shown in FIG. 8, the driving-force transmitter 100 includes the lever 160, which may swing by the guidance of the second cam portion 153. The lever 160 is swingably supported by a supporting shaft 102A, which is fixed to the supporting plate 102. The lever 160 is provided to correspond to each of the colors of yellow, magenta, cyan, and black, The lever 160 may, in cooperation with the cam 150, engage with the sun gear 121, which is one of the elements in the planetary gear assembly, to restrict the sun gear 121 from rotating so that the clutch 120 may be placed in the engaging state, or may release the sun gear 121 so that the clutch 120 may be placed in the disengaging state. The lever 160 may switch states of the clutch 120 between the engaging state and the disengaging state when the cam 150 rotates in the normal direction and maintain the clutch 120 in the disengaging state when the cam 150 rotates in the reverse direction.

Figure 12A:
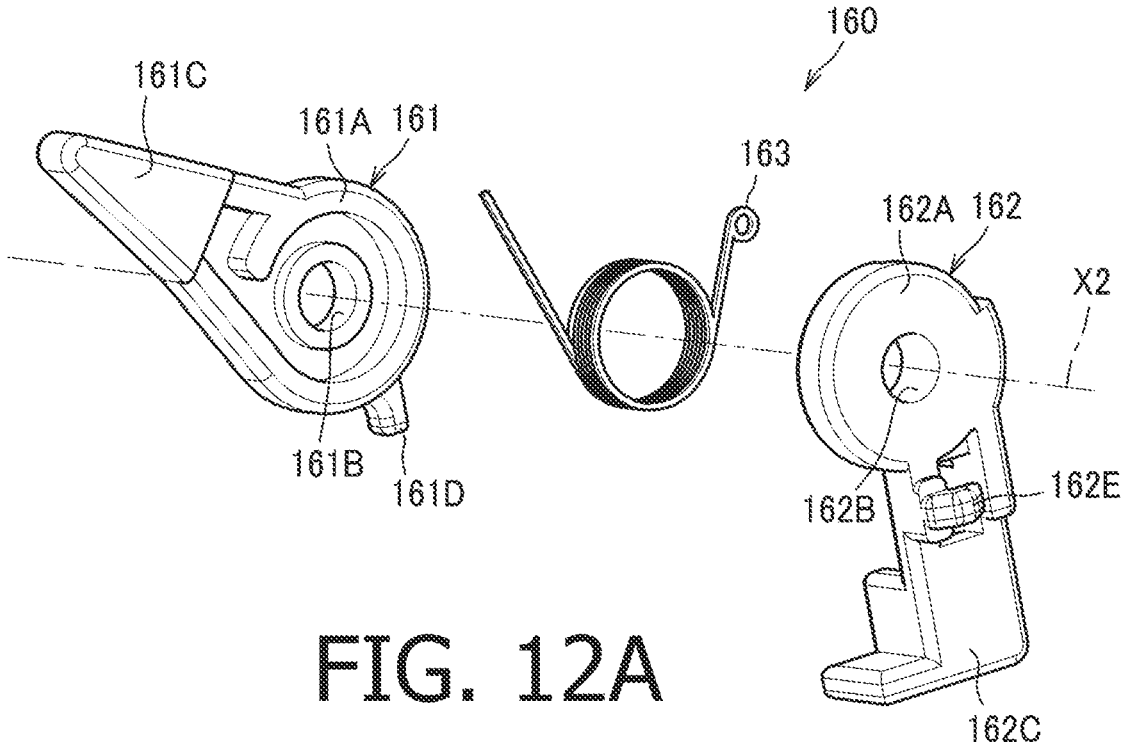
FIG. 12A is an exploded view of a lever in the image forming apparatus according to the embodiment of the present disclosure.

As shown in FIG. 12A, the lever 160 includes a first lever 161, a second lever 162, and a second spring 163. The first lever 161 is swingable about a swing axis X2, which is a center axis of the supporting shaft 102A and may contact the second cam portion 153 of the cam 150. The first lever 161 includes a rotation-supporting portion 161A having a hole 161B, in which the supporting shaft 102A fits, a first arm 161C extending from the rotation-supporting portion 161A, and a protrusion 161D protruding from the rotation-supporting portion 161A on a side opposite to the first arm 161C across the swing axis X2.

Figure 12B:
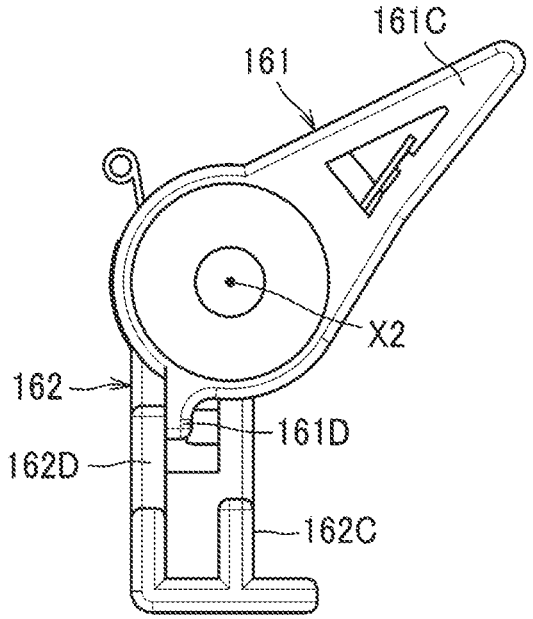
FIG. 12B is a side view of a first lever being restricted by a rotation-restrictive portion from rotating in the image forming apparatus according to the embodiment of the present disclosure.
Figure 12C:
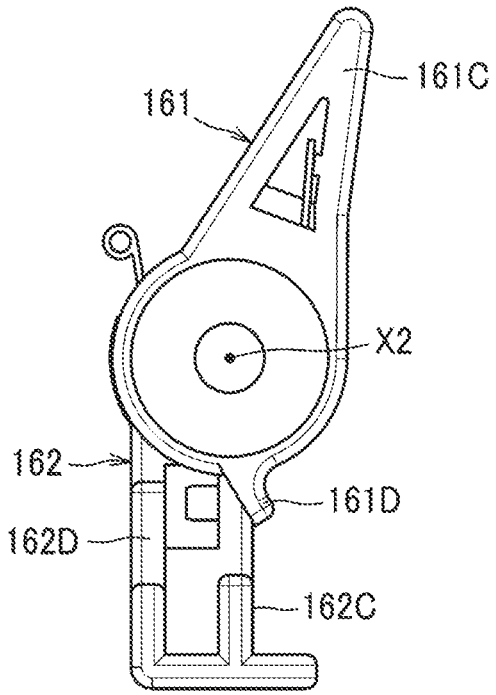
FIG. 12C is a side view of the first lever swinging relatively to a second lever in the image forming apparatus according to the embodiment of the present disclosure.

The second lever 162 is swingable about the swing axis X2. The second lever 162 is engageable with the sun gear 121 being one of elements in the clutch 120. The second lever 162 is coupled with the first lever 161 and is swingable with respect to the first lever 161 about the swing axis X2. In other words, the first lever 161 is coupled to the second lever 162 in an arrangement such that the first lever 161 may swing with respect to the second lever 162 about the swing axis X2. In the present embodiment, a position of the first lever 161 as shown in FIG. 12C, in which the first lever 161 moved to swing with respect to the second lever 162 against the urging force of the second spring 163, may be called as a swung position.

The second lever 162 includes a rotation-supporting portion 162A having a hole 162B, in which the supporting shaft 102A fits, a second arm 162C extending from the rotation-supporting portion 162A, a rotation-restrictive portion 162D, and a spring hook 162E. The rotation-restrictive portion 162D protrudes from the second arm 162C in a direction parallel to the swing axis X2. The rotation-restrictive portion 162D may restrict the second lever 162 from rotating with respect to the first lever 161 in one direction by contacting the protrusion 161D. In particular, as the first lever 161 swings, the protrusion 161D may collide with the rotation-restrictive portion 162D of the second lever 162, as shown in FIG. 12B, and may be restricted from rotating further.

The second spring 163 may be a torsion spring and may urge the first lever 161 with respect to the second lever 162 in a direction, in which the protrusion 161D may be urged against the rotation-restrictive portion 162D. In other words, the second spring 163 may urge the first lever 161 to cause the rotation-restrictive portion 162D in the second lever 162 to contact the protrusion 161D in the first lever 161 so that the first lever 161 may not rotate with respect to the second lever 162.

In the lever 160, with the first lever 161 and the second lever 162 being coupled with each other, the second arm 162C extends in an arrangement such that a tip end thereof points at an outer circumferential surface of the disc portion 121B of the sun gear 121. Meanwhile, to the spring hook 162E, as shown in FIG. 19B, hooked is an end of a third spring 169. The third spring 169 may be a contractive spring, and the other end of the third spring 169 is hooked to a spring hook, which is not shown, formed in the supporting plate 102. Thus, the third spring 169 may urge the second arm 162C of the second lever 162 to swing in a direction toward the outer circumferential surface of the disc portion 121B, or the sun gear 121, which is one of elements forming a planetary gear assembly. The second arm 162C may engage with a claw portion 121C formed on the outer circumferential surface of the sun gear 121 to restrict the sun gear 121 from rotating.

The lever 160 may contact the outer circumferential surface of the second cam portion 153 of the cam 150 at the tip end of the first arm 161C. The lever 160 is movable between a transmittable position, in which the tip end of the first lever 161 is separated from the second cam portion 153 and the second lever 162 engages with the claw portion 121C in the clutch 120 to place the clutch 120 in the engaging state, as shown in FIGS. 19A-19B, and a discontinuing position, in which the tip end of the first lever 161 contacts the second cam portion 153 to be pushed by the second cam portion 153 so that the tip end of the second lever 162 is disengaged from the claw portion 121C in the sun gear 121 being one of the elements forming the planetary gear assembly to place the clutch 120 in the disengaging state, as shown in FIGS. 20A-20B.

Moreover, when the lever 160 is at the transmittable position, in which the second lever 162 engages with the claw portion 121C in the sun gear 121 being one of the elements forming the planetary gear assembly, and when the motor 3 rotates in the reverse direction, the first lever 161 may be pushed by the second cam portion 153, and the first lever 161 may swing relatively to the second lever 162 against the urging force of the second spring 163 to move to the swung position, as shown in FIG. 24A. Thus, with the first lever 161 swingable relatively to the second lever 162, the lever 160 may be restrained from bearing an excessive load from the motor 3 when the motor 3 rotates in the reverse direction.

Next, described in the following paragraphs will be actions in the image forming apparatus 1 under control of the controller 2. The controller 2 may control overall actions in the image forming apparatus 1. The controller 2 includes a CPU, a ROM, a RAM, and input/output device, which are not shown. The controller 2 may execute predetermined programs to process operations.

For example, the controller 2 may control the YMC clutch 140A and the clutch 140K based on signals from the separation sensors 4C, 4K to control the contacting and separating motions of the developing roller 61 with respect to the photosensitive drum 50.

Moreover, when the cover 11 moves from the open position to the closed position, the controller 2 may conduct a first initializing control (see S101-S153 in FIGS. 14A-14B), in which the controller 2 controls the cam 150 to rotate in the reverse direction, and based on the timing when the light emitted from the light-emitter in the separation sensor 4C/4K passes through either the first slit 154A or the second slit 154B, after detecting the first slit 154A, stop the cam 150. Further, the controller 2 may conduct a second initializing control (see S160-S171 in FIG. 14B), in which the controller 2 controls the cam 150 to rotate and stop the cam 150 at a position, at which the light emitted from the light emitter in the separation sensor 4C/4K passes through the first slit 154A. Furthermore, when the image forming apparatus 1 forms an image on a sheet S, in order to maintain the developing roller 61 at the contacting position, the controller 2 may stop the cam 150 at a position in a phase, in which the light emitted from the light emitter in the separation sensor 4C/4K passes through the second slit 154B. The controls by the controller 2 may be conducted, for example, according to the flows shown in FIGS. 13-14.

Figure 13:
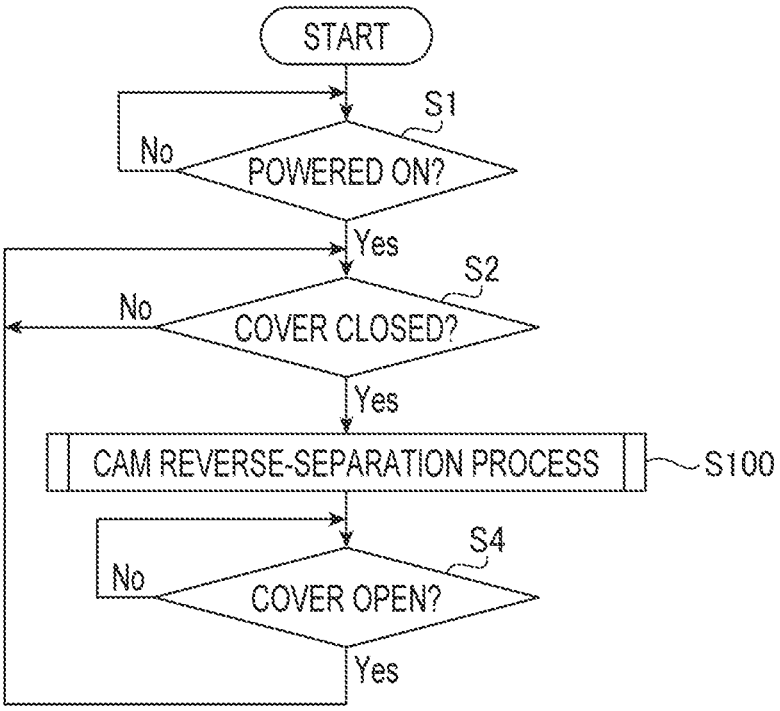

As shown in FIG. 13, in S1, the controller 2 determines whether the image forming apparatus 1 is powered on. If the controller 2 determines the image forming apparatus 1 is powered (S1: YES), the flow proceeds to S2, but if the controller 2 determines that the image forming apparatus 1 is not powered (S1: NO), the controller 2 waits until the image forming apparatus 1 is powered.

After the image forming apparatus 1 is powered on, in S2, the controller 2 determines, based on signals from the cover sensor, whether the cover 11 is closed or not. If the controller 2 determines that the cover 11 is not closed (S2: NO), the controller 2 waits until the cover 11 is closed. If the controller 2 determines that the cover 11 is closed (S2: YES), in S100, the controller 2 conducts a cam reverse-separation process, in which the controller 2 manipulates the cam 150 to rotate in the reverse direction to separate the developing roller 61 from the photosensitive drum 50. Thereafter, in S4, the controller 2 determines, based on signals from the cove sensor, whether the cover 11 is open. If the controller 2 determines that the cover 11 is not open (S4: NO), the controller 2 waits until the cover 11 opens. If the controller 2 determines that the cover is open (S4: YES), the flow returns to S2 and waits until the cover 11 is closed.

Figure 14A:
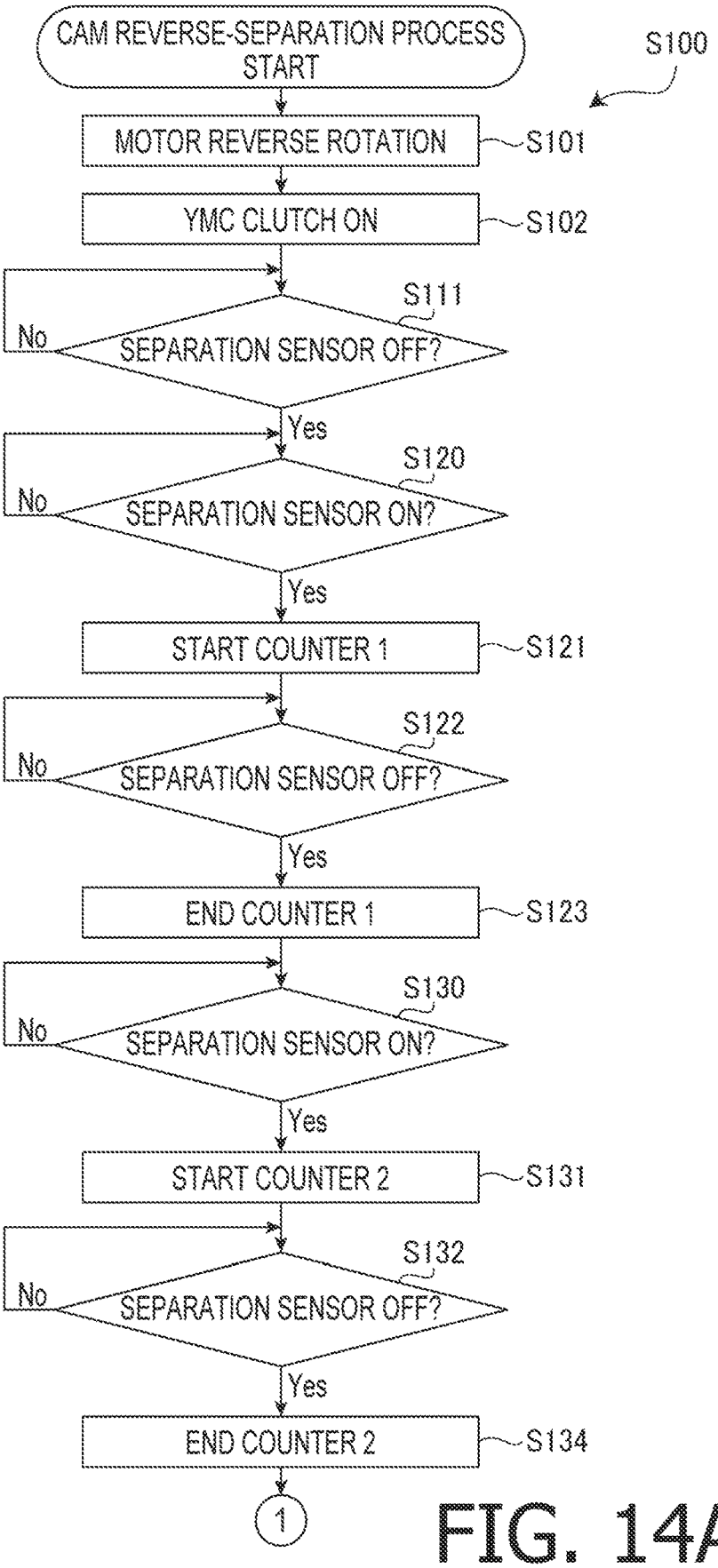
FIGS. 14A-14B are flowcharts to illustrate flows of steps to be conducted in a cam-reverse separating process in the image forming apparatus according to the embodiment of the present disclosure.

When the controller 2 determines that the cover 11 is closed (S2: YES), the controller 2 conducts a process to place the cam 150, the lever 160 and the cam follower 170 which may interact with the cam 150, at respective initial positions through the cam reverse-separation process (S100) as shown in FIG. 14A. In the present embodiment, the process to place the cam 150, the lever 160, and the cam follower 17 at the initial positions thereof may be called as an initializing action.

In the cam reverse-separation process, in S101, the controller 2 rotates the motor 3 in the reverse direction, and in S102, activates the YMC clutch 140A. Thereby, the cam 150, in particular, the cams 150Y, 150M, 150C, rotates in the reverse direction.

In S111, the controller 2 determines whether the separation sensor 4C is switched OFF. If the separation sensor 4C is not OFF (S111: NO), the controller 2 waits until the separation sensor 4C is switched OFF. If the controller 2 determines that the separation sensor 4C is OFF (S111: YES), in S120, the controller 2 determines whether the separation sensor 4C is thereafter switched ON. If the separation sensor 4C is not switched ON (S120: NO), the controller 2 waits until the separation sensor 4C is switched ON. If the controller 2 determines that the separation sensor 4C is switched ON (S120: YES), in S121, the controller 2 starts counting for a counter 1. The counter 1 indicates a value, which corresponds to a size of a slit detected firstly by the separation sensor 4C after the cam 150 started the reverse rotation. in other words, the controller 2 starts measuring a size of the slit which is detected firstly after the cam 150 started the reverse rotation. In S122, the controller 2 determines whether the separation sensor 4C is switched OFF. If the separation sensor 4C is not OFF, the controller 2 waits until the separation sensor 4C is switched OFF. If the separation sensor 4C is switched OFF (S122: YES), in S123, the controller 2 ends counting for the counter 1.

In S130, the controller 2 determines whether the separation sensor 4C is switched ON, and if the separation sensor 4C is not ON (S130: NO), the controller 2 waits until the separation sensor 4C is switched ON. If the separation sensor 4C is switched ON (S130: YES), in S131, the controller 2 starts counting for a counter 2. The counter 2 indicates a value, which corresponds to a size of a slit detected secondly by the separation sensor 4C after the cam 150 started the reverse rotation. In S132, the controller 2 determines whether the separation sensor 4C is switched OFF. If the separation sensor 4C is not OFF, the controller 2 waits until the separation sensor 4C is switched OFF. If the separation sensor 4C is switched OFF (S132: YES), in S134, the controller 2 ends counting for the counter 2.

In S140, the controller 2 determines whether the counter 2 indicates a value greater than a predetermined threshold value. The predetermined threshold value is a value representing a time length between a time length, which is required for the first slit 154A to pass by the separation sensor 4C, and a time length, which is required for the second slit 154B to pass by the separation sensor 4C. In S140, if the controller 2 determines that the counter 2 indicates a value greater than the predetermined threshold value (S140: YES), it may be determined that the slit that passed through the separation sensor 4C to cause the separation sensor 4C to output the signal is the second slit 154B. Therefore, the controller 2 waits until the separation sensor 4C is switched ON (S141: YES) and thereafter switched OFF (S142: YES). After the separation sensor 4C is switched OFF (S142: YES), or in S140, if the controller 2 determines that the counter 2 indicates a value not greater than the predetermined threshold value (S140: NO), the flow proceeds to S150. In S150, the controller 2 waits until a predetermined time period T1 elapses. The predetermined time period T1 is a period required for the cam 150 to rotate for a predetermined angle after the first slit 150A passed through the separation sensor 4C. If the controller 2 determines that the predetermined time period T1 elapses (S150: YES), in S151, the controller 2 deactivates the YMC clutch 140A and, in S152, stores a state "SD" of the cam 150 in a memory, e.g., the RAM. The cam 150 may stop when the YMC clutch 140A is deactivated.

Figure 15:
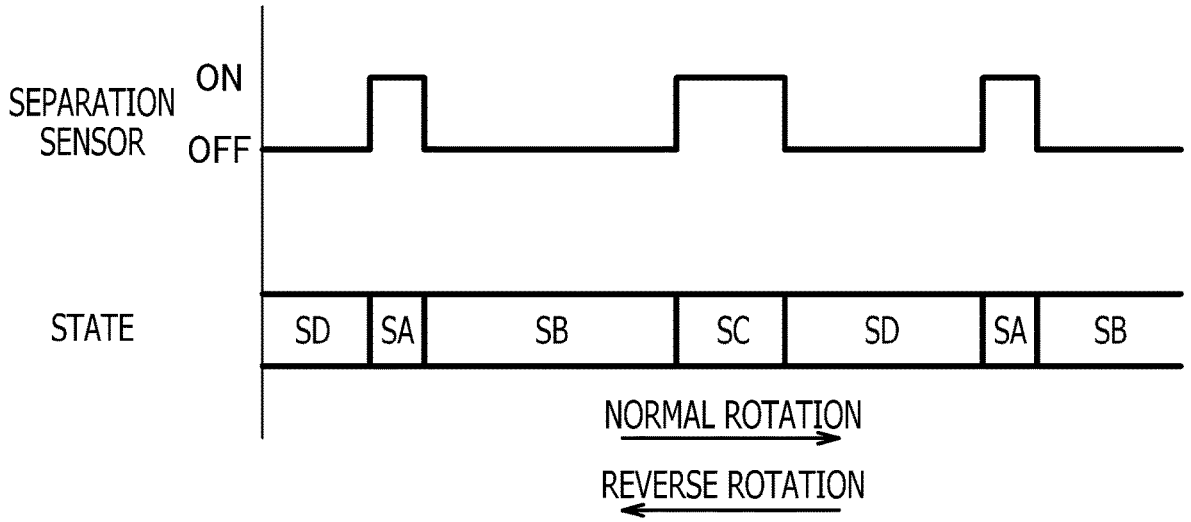
FIG. 15 is a chart to illustrate relation between signals from a separation sensor and states of the developing roller in the image forming apparatus according to the embodiment of the present disclosure.

In this paragraph, distinguishable states of the cam 150 will be described. As shown in FIG. 15, when the cam 150 rotates in the normal direction or the reverse direction, the separation sensors 4C, 4K each may output a shorter ON signal, which is generated by detecting the first slit 154A, and a longer ON signal, which is generated by detecting the second slit 154B, to the controller 2. Therefore, when the controller 2 receives the longer ON signal longer than a predetermined threshold length, the controller 2 may determine that the ON signal was generated by the second slit 154B; but when the controller receives the shorter ON signal shorter than the predetermined threshold length, the controller 2 may determine that the ON signal was generated by the first slit 154A. In this regard, a state of the cam 150, in which the first slit 154A is located in the separation sensor 4C/4K, may be stored as a state "SA" in the memory. As the cam 150 rotates in the normal direction, the separation sensor 4C/4K may be switched between ON and OFF, and the states of the cam 150 to be stored in the memory may shift in circulation in an order: SA-SB-SC-SD-SA . . . . Therefore, based on the information stored in the memory, the controller 2 may recognize the current state of the cam 150. On the other hand, when the cam 150 rotates in the reverse direction, the states of the cam 150 may shift in the reversed order. Therefore, as the separation sensor 4C/4K is switched between ON and OFF, the states of the cam 150 to be stored in the memory may shift in circulation in an order SA-SD-SC-SB-SA . . . . In this regard, in S152 mentioned above, the controller 2 may determine that the cam 150 is in the state SD based on the condition that the separation sensor 4C is switched OFF after outputting the shorter ON signal while the cam 150 is rotating in the reverse direction.

Referring back to FIG. 14B, in S153, the controller 2 stops the motor 3. In S160, the controller 2 rotates the motor 3 in the normal direction, and in S160, activates the YMC clutch 140A. In S162, if the separation sensor 4C is not ON (S162: NO), the controller 2 waits until the separation sensor 4C is switched on (S162: YES) and in S163, waits for a predetermined time period T2, since the time when the separation sensor 4C is switched ON, to elapse. After the predetermined time period T2 elapses (S162: YES), in S164, the controller 2 stores the state SA of the cam 150 in the memory. In S170, the controller 2 deactivates the YMC clutch 140A, and in S171, stops the motor 3. The predetermined time period T2 in S163 may be a time period, in which, after the cam 150 is stopped, the light from the light-emitter in the separation sensor 4C may pass through a center of the first slit 154A. The predetermined time period T2 is shorter than the predetermined time period T1.

It may be noted that the above paragraphs described the process to locate any of the cams 150Y, 150M, 150C for yellow, magenta, and cyan at the initial position. Meanwhile, the cam 150K for black may be similarly located at the initial position thereof through the same process by controlling the K clutch 140K instead of the YMC clutch 140A based on the signal from the separation sensor 4K instead of the separation sensor 4C. Therefore, detailed description of the process to locate the cam 150K at the initial position is herein omitted.

In the following paragraphs, with reference to a timing chart in FIG. 18 and the drawings in FIGS. 19-24, movements of the members in the image forming apparatus 1 under the control by the controller 2 as described above will be described.

When the cover 11 is at the closed position, and while the image forming apparatus 1 is operating normally, as shown in FIGS. 19A-19B, the contacting portion 172 of the cam follower 170 may be located on the first retainer face F1 of the first cam portion 152, i.e., in the arrangement where the developing roller 61 is at the contacting position; or may be located on the second retainer face F2 of the first cam portion 152 as shown in FIGS. 20A-20B, i.e., in the arrangement where the developing roller 61 is at the separated position. In either case, while the motor 3 rotates in the normal direction and the cam 150 rotates in the normal direction, e.g., clockwise in FIGS. 19A-B and 20A-20B, a friction force produced between the contacting portion 172 and the first cam portion 152 may lift the contacting portion 172 upward and urge the cam follower 170 to pivot counterclockwise in FIGS. 19A-B and 20A-20B. Thus, the cam follower 170 may be placed in a predetermined posture by the contact at the arm 173 with the release-engagement portion 182A.

In the arrangement as shown in FIGS. 20A-20B, where the contacting portion 172 is located on the second retainer face F2 while the developing roller 61 is at the separated position, the cover 11 may be moved from the closed position to the open position. When the cover 11 moves to the open position, the releasing member 180 may be pulled by the cover 11 to move linearly frontward, as shown in FIGS. 21A-21B. Accordingly, the coupling shaft 119 may be pushed by the coupling-withdrawable cam 181B of the releasing member 180 outward in the rotation-axis direction to be detached from the coupling 65. Moreover, as the releasing member 180 moves linearly frontward, the release-engagement portion 182A may urge the arm 173 of the cam follower 170 frontward, causing the cam follower 170 to pivot from the operable position to the inoperable position. Therefore, by the cam-follower retainer 182B contacting the arm 173, the posture of the cam follower 170 may be maintained. In this arrangement, as long as the cover 11 is open, and the cam-follower retainer 182B retains the posture of the cam follower 170, the cam follower 170 may be maintained at the inoperable position regardless of the phase of the cam 150.

As the cam follower 170 pivots from the operable position to the inoperable position, the first sprig 176 keeps urging the cam follower 170 toward the standby position. Therefore, at the moment when the contacting portion 172 is separated from the first cam portion 152, the cam follower 170 may move from the protrusive position to the standby position, causing the developing roller 61 to move from the separated position to the contacting position. With the cam follower 170 being located at the standby position, the slidable shaft 171 may retract from the second opening 91A; therefore, if the drawer 90 is pulled outward from the casing 10, or if the drawer 90 drawn outside the casing 10 is pushed back in the casing 10, the slidable shaft 171 may not interfere with the side frame 91L of the drawer 90.

Figure 16:
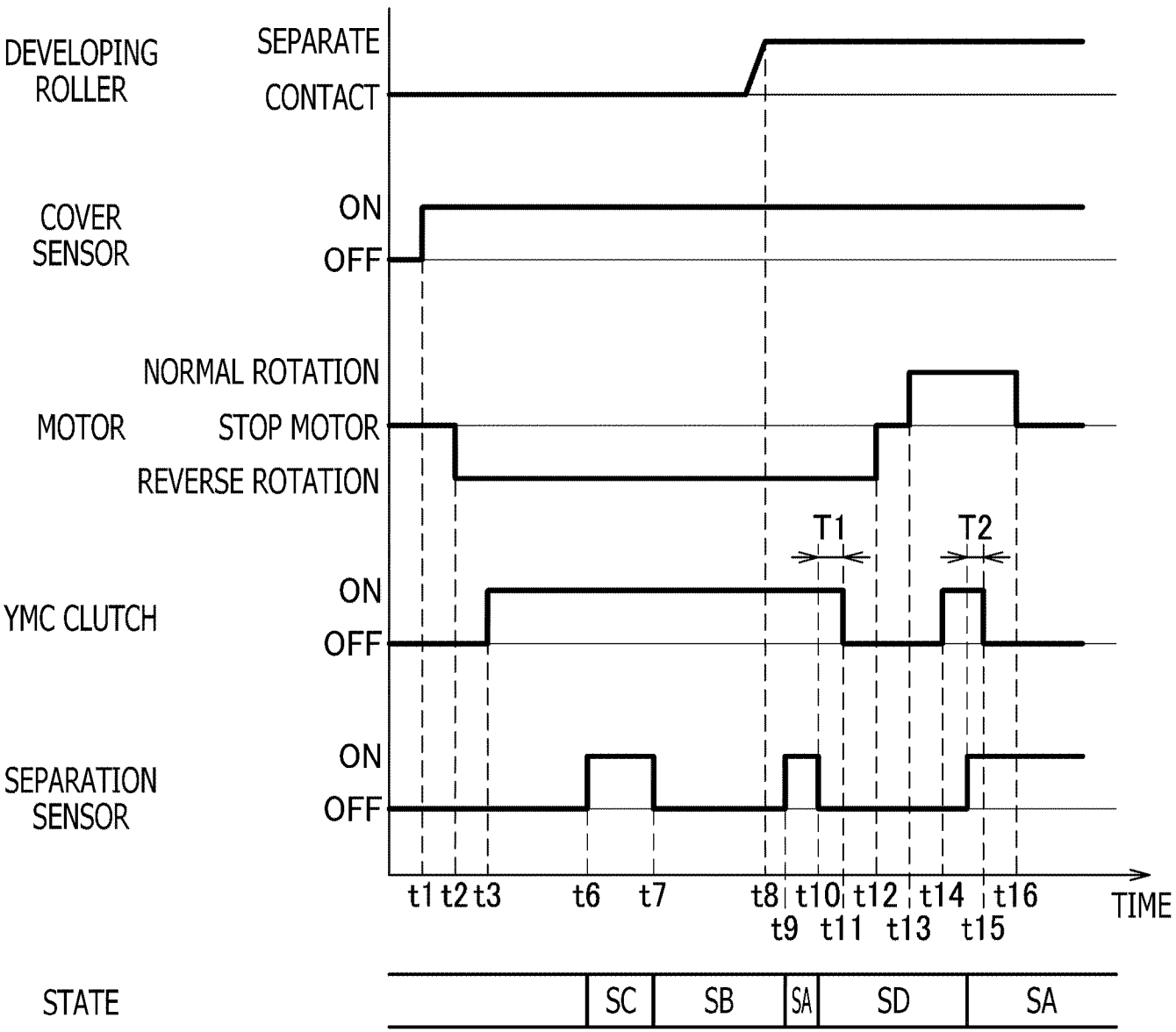
FIG. 16 is a timing chart to illustrate behaviors of some components in the image forming apparatus according to the embodiment of the present disclosure while the image forming apparatus is powered and when the separation sensor firstly detects a second slit.

Thereafter, when the cover 11 is moved from the open position to the closed position, the cover sensor may be switched ON (t1 in FIG. 16), and the releasing member 180 may move rearward linearly, as shown in FIGS. 22A-22B. Thereby, the coupling shaft 119 may protrude inward and engage with the coupling 65. Moreover, as the releasing member 180 moves rearward, the upward face of the cam-follower retainer 182B may be separated from the arm 173 of the cam follower 170, in other words, the arm 173 of the cam follower 170 may no longer be retained by the cam-follower retainer 182B. However, with the contacting portion 172 contacting the outer circumferential surface of the first cam portion 152, the cam follower 170 may be retained at the inoperable position. Meanwhile, a lower end of the arm 173 may be located at an upper position with respect to the upward face of the stopper 183; therefore, the arm 173 may not interfere with the stopper 183, and the stopper 183 may move rearward underneath the arm 173.

Meanwhile, in an arrangement, in which the cover 11 is at the closed, position, the contacting portion 172 is located on the first retainer face F1, and the developing roller 61 is located at the contacting position, the cover 11 may be moved from the closed position to the open position and moved back to the closed position. Thereby, the cam follower 170 may be moved by the urging force of the first spring 176 to pivot and return to the position, at which the contacting portion 172 may contact the first cam portion 152 (see FIGS. 19A-19B). In other words, the cam follower 170 may pivot from the inoperable position to the operable position when the cover 11 moves from the open position to the closed position.

After the cover 11 is placed at the closed position, the controller 2 may rotate the motor 3 in the reverse direction (t2) and activate the YMC clutch 140A (t3). Thereby, the cam 150 may rotate in the reverse direction. In particular, the cam 150 may rotate in the reverse direction from the position shown in FIGS. 22A-22B, in which the contacting portion 172 contacts the outer circumferential surface of the first cam portion 152. As the cam 150 rotates in the reverse direction, as shown in FIG. 23A, when the contacting portion 172 separates from the outer circumferential surface of the first cam portion 152, the cam follower 170 being urged by the first spring 176 may pivot counterclockwise from the inoperable position to the operable position. Meanwhile, the stopper 183 may be pushed by the arm 173 of the cam follower 170 and swing downward for once. Moreover, while the cam 150 rotates from the position shown in FIG. 22A to the position shown in FIG. 23A, the separation sensor 4C may detect the second slit 154B and output the longer ON signal (t6-t7).

As the cam 150 rotates further in the reverse direction, the contacting portion 172 may contact the second guiding face F4 of the first cam portion 152, as shown in FIG. 23B, and may be pushed downward by the first cam portion 152. Due to the friction force between the second guiding face F4 and the contacting portion 172, as the contacting portion 172 is pushed downward, the cam follower 170 may pivot clockwise, and when the arm 173 contacts the stopper 183, the posture of the cam follower 170 may be maintained. Therefore, the cam follower 170 being pushed by the second guiding face F4 may, without pivoting further, move toward the protrusive position.

As the cam 150 rotates further in the reverse direction from the position shown in FIG. 23B, the second retainer face F2 moves to contact the contacting portion 172, in other words, the contacting portion 172 is located on the second retainer face F2, and the slidable shaft 171 is located at the protrusive position. Therefore, the developing roller 61 may be placed at the separated position (t8). Thereafter, the first slit 154A may pass through the separation sensor 4C, and the separation sensor 4C may be switched ON (t9), and thereafter, switched OFF (t10). Moreover, the first lever 161 in the lever 160 may contact the second cam portion 153. Meanwhile, the second lever 162 engaged with the sun gear 121 may not move. Therefore, in place of the second lever 162, the first lever 161 may swing against the urging force of the second spring 163 to the swung position. After the predetermined time period T1 from t10, at which the separation sensor 4C was switched OFF, the controller 2 may deactivate the YMC clutch 140A (t11) and stops the motor 3 (t12). The controller 2 may store the state SD of the cam 150 in the memory. It may be noted in FIGS. 16-17 that the states SA-SC of the cam 150 prior to t12 are illustrated for reference.

Thereafter, the controller 2 may rotate the motor 3 in the normal direction (t13) and activate the YMC clutch 140A (t14) to cause the cam 150 to rotate in the normal direction for the predetermined angle. After the predetermined time period T2 since the first slit 154A reached the separation sensor 4C and the separation sensor 4C was switched ON, the controller 2 may deactivate the YMC clutch 140A (t15). Thereafter, the controller 2 may stop the motor 3 (t16). Thus, with the contacting portion 172 being located on the second retainer face F2, as shown in FIG. 24B, and the slidable shaft 171 being located at the protrusive position, the developing roller 61 may be located at the separated position. Meanwhile, the lever 160 has the second lever 162, which may be hooked to the claw portion 121C in the sun gear 121, and the first lever 161, of which tip end may be separated rightward from the second cam portion 153 in FIG. 24B. Thus, when the image forming apparatus 1 is powered on and the cover 11 is closed, the initializing action may be completed, and the cam 150 may be placed at the initial position.

Figure 17:
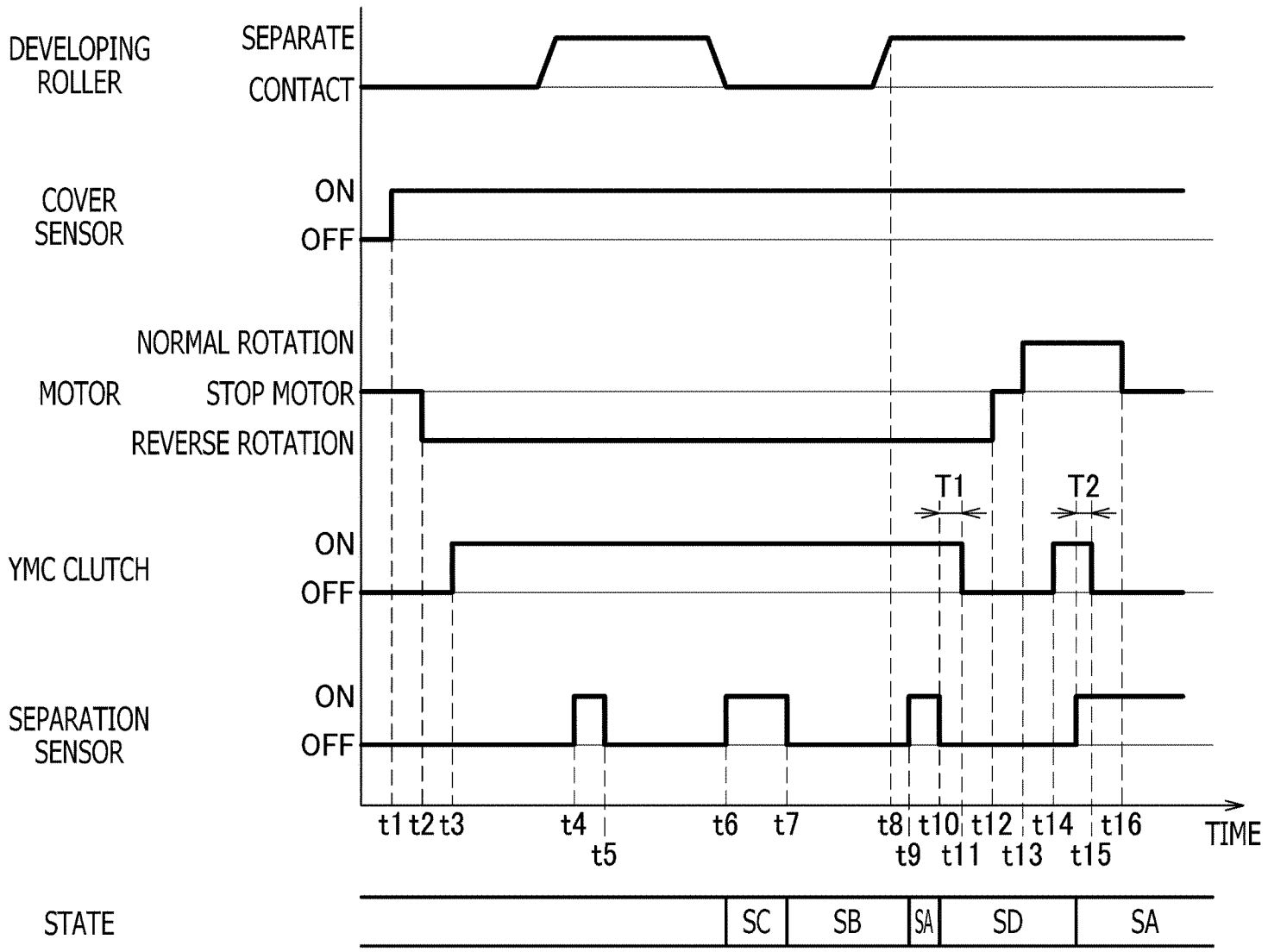
FIG. 17 is a timing chart to illustrate behaviors of the components in the image forming apparatus according to the embodiment of the present disclosure while the image forming apparatus is powered and when the separation sensor firstly detects a first slit.

Described above with reference to FIG. 16 is an example of the initializing action, which may be conducted when the second slit 154B passes through the separation sensor 4C firstly after the cover 11 is closed and the cam 150 started rotating in the reverse direction. However, as shown in FIG. 17, there may be another case that the first slit 154A may pass through the separation sensor 4C firstly after the cover 11 is closed and the cam 150 started rotating in the reverse direction. In such a case, if the first slit 154A passes through the separation sensor 4C firstly (t4-t5), after the second slit 154B passes through the separation sensor 4C (t6-t7), and further after the predetermined time period t1 since the first slit 154A passes through the separation sensor 4C (t9-t10), the controller 2 may stop the cam 150 (t11). Thereafter, the controller 2 may cause the cam 150 to rotate in the normal direction (t14), and after the predetermined time period T2 since the separation sensor 4C was switched ON, the controller 2 may deactivate the YMC clutch 140A (t15). Thus, the cam 150 may be stopped at the initial position in the same manner as the initializing action shown in FIG. 16.

Next, with reference to FIG. 25, movements of the members in the image forming apparatus 1 under the control of the controller 2 when an image is formed will be described below. In FIG. 25, while a top row indicates movement of the developing roller 61Y for yellow in a timeline, movements of the second, third, and fourth developing rollers 61M, 61C, 61K for magenta, cyan, and black are overlaid on the same timeline.

For multicolored image printing, prior to an image forming operation, the initializing action is completed; therefore, the first, second, third, and fourth developing rollers 61Y, 61M, 61C, 61K are all located at the respective separated positions. In order to locate the first, second, third, and fourth developing rollers 61Y, 61M, 61C, 61K at the respective contacting positions, the controller 2 activates the YMC clutch 140A and the K clutch 140K to cause the cams 150Y, 150M, 150C, 150K to rotate in the normal direction (t0). In the following paragraphs, the cam 150K rotating in the normal direction may be simply expressed as "the cam 150K rotates." Shortly after the cams 150Y, 150M, 150C, 150K start rotating (t31), the separation sensors 4C, 4K are switched OFF. Thereafter, the controller 2 drives the feeder roller 23 (t51) for a predetermined period so that the sheet S may be picked up and conveyed.

After a time period T11 elapsed (t32), since the separation sensor 4C for cyan output the OFF signal, the controller 2 deactivates the YMC clutch 140A to cause the cams 150Y, 150M, 150C to pause. The time period T11 is set to have a length, in which the contact portion 172 of the cam follower 170 for yellow reaches the position on the second retainer face F2 of the cam 150Y most adjacent to the second guide face F4 at the time when the cams 150Y, 150M, 150C pause.

After a time period T12 elapsed, since t53 when the pre-registration sensor 28B output the ON signal, i.e., when the leading edge of the sheet S passes by the pre-registration sensor 28B, the controller 2 activates the YMC clutch 140A to resume the rotation of the cams 150Y, 150M, 150C (t33). The time period T12 is set to have a length, in which the development of the toner image on the first photosensitive drum 50Y by the first developing roller 61Y may be rendered in time without being late for the transfer of the developed toner image onto the sheet S.

After a time period T21 elapsed, since the separation sensor 4K for black output the OFF signal, the controller 2 deactivates the K clutch 140K to stop the rotation of the cam 150K (t42). The time period T21 is set to have a length, in which the contact portion 172 of the cam follower 170 for black may be located at the position on the second retainer face F2 of the cam 150K most adjacent to the second guide face F4 at the time when the cam 150K pauses.

After a time period T22 elapsed, since t54 when the post-registration sensor 28C output the ON signal, i.e., since the leading edge of the sheet S passed by the post-registration sensor 28C, the controller 2 activates the K clutch 140K to rotate the cam 150K (t43). The time period T22 is set to have a length, in which the development of the toner image in black on the fourth photosensitive drum 50K by the fourth developing roller 61K may be rendered in time to be transferred onto the sheet S.

Next, after a time period T13 elapsed, since t34 when the separation sensor 4C for cyan output the ON signal, the controller 2 deactivates the YMC clutch 140A (t35) to stop the cams 150Y, 150M, 150C. The time period T13 is set to have a length, in which the first developing roller 61Y, the second developing roller 61M, and the third developing roller 61C may all be located at the respective contacting positions, and in which the cams 150Y, 150M, 150C may be stopped at positions corresponding to a position of the cam 150C where the light from the light emitter in the separation sensor 4C passes through a center of the second slit 154B in the cam 150C in the circumferential direction.

After a time period T23 since t43 elapsed, since t36 when the separation sensor 4K for black output the ON signal, the controller 2 deactivates the K clutch 140K to stop the rotation of the cam 150K (t44). The time period T23 is set to have a length, in which the fourth developing roller 61K is moved and located at the contacting position, and in which the cam 150K may be stopped at a position where the light from the light emitter in the separation sensor 4K passes through the center of the second slit 154B in the cam 150K in the circumferential direction.

After a time period T14 elapsed, since t57 when the post-registration sensor 28C output the OFF signal, i.e., since the trailing end of the sheet S passed by the post-registration sensor 28C, the controller 2 activates the YMC clutch 140A (t37) to rotate the cams 150Y, 150M, 150C to cause the first developing roller 61Y, the second developing roller 61M, the third developing roller 61C to be sequentially separated from the first photosensitive drum 50Y, the second photosensitive drum 50M, and the third photosensitive drum 50C, respectively. The time period T14 is set to have a length, in which, after the toner image in yellow is completely developed on the first photosensitive drum 50Y by the first developing roller 61Y, and shortly after completion of transferring the toner image from the first photosensitive drum 50Y to the sheet S, the first developing roller 61Y becomes ready to be moved to the separated position.

After a time period T24 elapsed, since t57 when the post-registration sensor 28C output the OFF signal, the controller 2 activates the K clutch 140K to rotate the cam 150K (t45). The time period T24 is set to have a length, in which, after the toner image in black is completely developed on the fourth photosensitive drum 50K by the fourth developing roller 61K, and shortly after completion of transferring the toner image from the fourth photosensitive drum 50K to the sheet S, the fourth developing roller 61K becomes ready to be moved to the separated position.

After a time period T15 elapsed, since t38 when the separation sensor 4C for cyan output the OFF signal, the controller 2 deactivates the YMC clutch 140A to stop the cams 150Y, 150M, 150C (t40). The time period T15 is set to have a length, in which the cams 150Y, 150M, 150C may be stopped at positions corresponding to a position of the cam 150C where the light from the light emitter in the separation sensor 4C passes through the center of the first slit 154A in the cam 150C in the circumferential direction.

After a time period T25 elapsed, since t39 when the separation sensor 4C for cyan output the OFF signal, the controller 2 deactivates the K clutch 140K to stop the cams 150K (t46). The time period T25 is set to have a length, in which the cam 150K may be stopped at a position where the light from the light emitter in the separation sensor 4K passes through the center of the first slit 154A in the cam 150K in the circumferential direction.

By the actions describe above, the cams 150Y, 150M, 150C, 150K may be maintained at the positions, in which the light emitted from the light emitters in the separation sensors 4C, 4K may pass through the centers of the second slits 154B in the circumferential direction. Therefore, the condition, in which the developing roller 61 is located at the contacting position may be reliably maintained.

According to the embodiment described above, when the cover 11 is moved from the closed position to the open position, the release-engagement portion 182A may contact the arm 173 of the cam follower 170 to move the cam follower 170 to the inoperable position. Meanwhile, the contacting portion 172 of the cam portion 170 is not guided by the first cam portion 152 when the cam follower 170 is located at the inoperable position. Therefore, the cam follower 170 may be maintained at the standby position irrelevantly from the rotation of the cam 150. In this arrangement, when the cover 11 is open, the cam 150 may be located at the standby position, and the cam follower 170 may be restrained from interfering with the side frame 91L of the drawer 90.

The cam 150 has the first cam portion 152, which may move the developing roller 61, and the phase-detector wall 154. The first cam portion 152 protrudes from the first face 151A on one side of the disc portion 151, and the phase-detector wall 154 protrudes from the same first face 151A as the first cam portion 152. Therefore, a size of the cam 150 may be restrained from increasing in the axial direction compared to an arrangement, in which the first cam portion 152 and the phase-detector wall 152 may be arranged on different sides. In this regard, the cam 150, which enables detection of the conditions of the developing roller contacting and separating from the photosensitive drum 50, may be formed compactly so that the image forming apparatus 1 may be downsized.

In particular, the phase-detector wall 154 is arranged in the space inside the inner circumferential face 152S of the first cam portion 152; therefore, the cam 150 may be formed in the compact shape effectively.

Meanwhile, the controller 2 may cause the cam 150 to rotate in the reverse direction to conduct the initializing action and stop the reverse rotation of the cam 150 after the first slit 154A in the phase-detector wall 154 is detected based on the time when the light emitted from the light-emitter transmits through either the first slit 154A or the second slit 154B. Therefore, the initializing action may be performed in a shorter time while the cam 150 may be stopped at the correct phase accurately.

Moreover, the controller 2 may cause the cam 150 to stop at the position, in which the light from the light-emitter transmits through the first slit 154A. Therefore, the initializing action may be completed while the developing roller 61 is reliably located at the separated position.

Moreover, when an image is being formed on the sheet S, the controller 2 may stop the cam 150 at the position, in which the light from the light-emitter passes through the second slit 154B. Therefore, compared to an example that the cam 150 may be stopped in a phase, in which the light from the light-emitter does not pass through the second slit 154B, the image forming operation may be conducted with the developing roller 61 being reliably placed to contact the photosensitive drum 50.

Moreover, according to the present embodiment, the cam follower 170 may be urged to move from the protrusive position to the standby position and from the inoperable position to the operable position by the same first spring 176. In this regard, a quantity of parts in the image forming apparatus 1 may be reduced or restrained from increasing.

Moreover, according to the present embodiment, when the cover 11 moves from the open position to the closed position, and if the cam follower 170 is located at the inoperable position, the stopper 183 may be pushed by the arm 173 to swing and allow the cam follower 170 to pivot from the inoperable position to the operable position. Therefore, the cam follower 170 may return to the operable position easily.

Moreover, according to the present embodiment, the lever 160 includes the first lever 161 and the second lever 162, and the first lever 161 is swingable with respect to the second lever 162. Therefore, when the motor 3 rotates in the reverse direction, the lever 160 may be restrained from bearing an excessive load from the motor 3.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the size of the second slit 154B in the circumferential direction may not necessarily be greater than the size of the first slit 154A in the circumferential direction but may be smaller than the size of the first slit 154A.

For another example, a quantity of the slits formed in different sizes in the circumferential direction in the phase-detector wall 154 may not necessarily be limited to two (2), but the phase-detector wall 154 may have three (3) or more slits in different sizes in the circumferential direction.

Figure 14B:
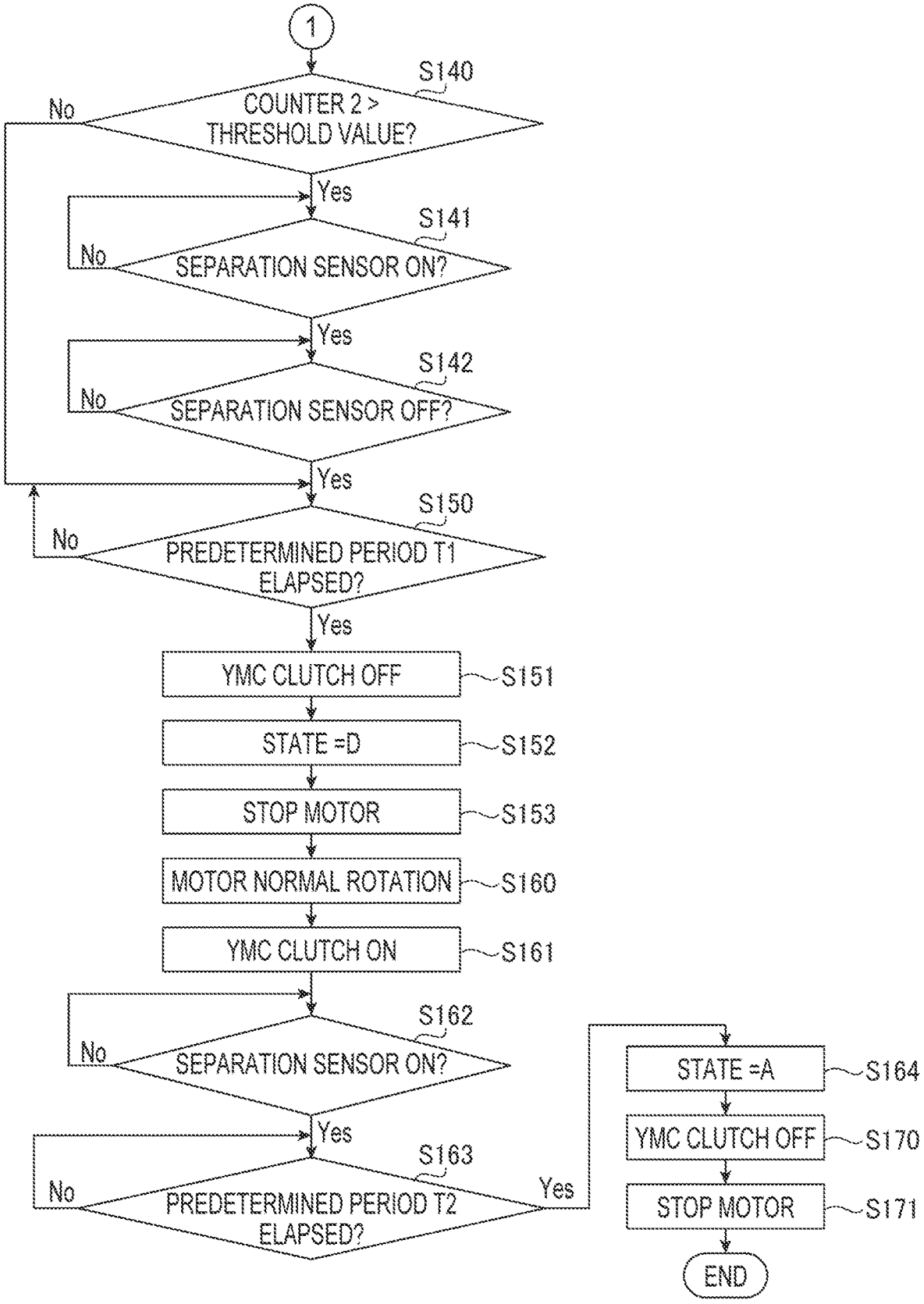

For another example, the controller 2 may not necessarily store the state of the cam 150 in the memory after S151 in FIG. 14B but may store the state of the cam 150 directly after determining whether the counter 2 indicates a value greater than the threshold value in S140.

For another example, the second opening 91A formed on the side frame 91L may not necessarily be in the cutout form which is open upward but may be, for example, a through hole formed through the side wall.

For another example, the image forming apparatus 1 may not necessarily be limited to an image forming apparatus for forming multicolored images in toners of four colors but may be an image forming apparatus for forming monochrome images or for forming multicolored images in toners of three colors, five colors, or a different number of colors.

For another example, the image forming apparatus may be a multifunction peripheral machine or a copier.

What is claimed is:

1. An image forming apparatus, comprising:

a casing having an opening;

a cover movable between a closed position, at which the opening is closed by the cover, and an open position, at which the opening is exposed;

a photosensitive drum;

a developing roller;

a photo-interrupter including a light-emitter and a light-receiver;

a moving mechanism configured to move the developing roller between a contacting position, at which the developing roller contacts the photosensitive drum, and a separated position, at which the developing roller is separated from the photosensitive drum, the moving mechanism comprising;

a cam configured to rotate about a rotation axis bidirectionally in a normal direction and a reverse direction, the cam including:

a first cam portion; and a phase-detector wall extending in a circumferential direction centered at the rotation axis of the cam, the phase-detector wall having a first slit, through which light emitted from the light-emitter is allowed to pass the phase-detector wall when the developing roller is at the separated position, and a second slit, through which the light emitted from the light-emitter is allowed to pass the phase-detector wall when the developing roller is at the contacting position, the second slit having a different size in the circumferential direction from the first slit; and a cam follower being slidably movable between a protrusive position and a standby position and being pivotable between an operable position and an inoperable position, the cam follower including a contacting portion, the contacting portion being configured to contact the first cam portion, and an arm, the arm extending in a direction different from the contacting portion; and a controller configured to, when the cover moves from the open position to the closed position, conduct a first initializing control, in which the controller causes the cam to rotate in the reverse direction and, after detecting the first slit based on a time period, in which the light emitted from the light-emitter passes through one of the first slit and the second slit, causes the cam to stop rotating.

2. The image forming apparatus according to claim 1, wherein the controller is configured to, after the first initializing control, conduct a second initializing control, in which the controller causes the cam to rotate in the normal direction and to stop rotating at a position, at which the light emitted from the light-emitter passes through the first slit.

3. The image forming apparatus according to claim 1, wherein the controller is configured to, when the image forming apparatus forms an image on a sheet, for maintaining the developing roller at the contacting position, cause the cam to stop in a phase, in which the light emitted from the light-emitter passes through the second slit.

4. The image forming apparatus according to claim 1, wherein the size of the second slit in the circumferential direction is greater than a size of the first slit in the circumferential direction.

5. The image forming apparatus according to claim 1, further comprising:

a developing cartridge supporting the developing roller; and a motor configured to rotate bidirectionally in a normal direction and a reverse direction under control of the controller, wherein the cam further comprises a second cam portion configured to rotate integrally with the first cam portion;

wherein the moving mechanism further comprises:

a driving-force transmitter gear train configured to transmit a driving force from the motor to the developing roller;

a driving-force controlling gear train configured to transmit the driving force from the motor to the cam, the driving-force controlling gear train being configured to rotate the cam in the normal direction when the motor rotates in the normal direction and in the reverse direction when the motor rotates in the reverse direction;

a clutch being switchable between an engaging state, in which the clutch engages transmission of the driving force from the motor to the developing roller, and a disengaging state, in which the clutch disengages transmission of the driving force from the motor to the developing roller;

a lever configured to swing by guidance of the second cam portion, the lever being configured to switch the clutch between the engaging state and the disengaging state when the cam rotates in the normal direction and maintain the clutch in the disengaging state when the cam rotates in the reverse direction;

a supporting shaft arranged on the casing; and a releasing member movable linearly in conjunction with opening and closing motions of the cover, the releasing member being configured to contact the arm and move the cam follower to pivot from the operable position to the inoperable position when the cover moves from the closed position to the open position;

wherein the cam follower is engaged with the supporting shaft and is slidably movable along an axial direction of the supporting shaft between the protrusive position and the standby position, the cam follower being pivotable about an axis of the supporting shaft between the operable position and the inoperable position;

wherein the arm in the cam follower extends in a direction to be away from the supporting shaft;

wherein the cam follower is:

when the cam follower is at the operable position, slidably movable between the protrusive position and the standby position as the cam rotates, with the contacting portion being guided by the first cam portion, the cam follower being configured to:

when the cam is at the protrusive position, press the developing cartridge to locate the developing roller at the separated position; and when the cam is at the standby position, locate the developing roller at the contacting position; and when the cam follower is at the inoperable position, with the contacting portion not being guided by the first cam portion, maintained at the standby position irrelevantly from rotation of the cam.

6. The image forming apparatus according to claim 5, wherein the moving mechanism includes a spring configured to urge the cam follower in a direction from the protrusive position toward the standby position and from the inoperable position toward the operable position.

7. The image forming apparatus according to claim 6, wherein the releasing member includes a release-engagement portion configured to engage with the arm; and wherein the release-engagement portion is configured to, when the cover is at the closed position, and when the cam rotates in the normal direction, with the first cam portion guiding the contacting portion, contact the arm to restrict the cam follower from pivoting about the axis of the supporting shaft.

8. The image forming apparatus according to claim 7, further comprising a stopper configured to move along with a linear motion of the releasing member to swing with respect to the releasing member, wherein, when the cover moved from the open position is located at the closed position and when the cam follower is located at the operable position, the stopper is in an arrangement, in which the arm is located between the release-engagement portion and the stopper, and is configured to contact the arm to restrict the cam follower from pivoting from the operable position to the inoperable position when the cam rotates in the reverse direction; and wherein, when the cover moved from the open position is located at the closed position and when the cam follower is located at the inoperable position, the stopper is configured to, when the cam follower is moved by an urging force of the spring to pivot toward the operable position, swing by being pushed by the arm and allow the cam follower to pivot from the inoperable position to the operable position.

9. The image forming apparatus according to claim 5, wherein the clutch includes a planetary gear assembly; and wherein the lever is swingable by the guidance of the second cam portion between a transmittable position, at which the lever engages with one of elements in the planetary gear assembly and places the clutch in the engaging state, and discontinuing position, at which the lever is disengaged from the one of the elements in the planetary gear assembly and places the clutch in the disengaging state.

10. An image forming apparatus, comprising:

a casing having an opening;

a cover movable between a closed position, at which the opening is closed by the cover, and an open position, at which the opening is exposed;

a photosensitive drum;

a developing roller;

a detector;

a moving mechanism configured to move the developing roller between a contacting position, at which the developing roller contacts the photosensitive drum, and a separated position, at which the developing roller is separated from the photosensitive drum, the moving mechanism comprising:

a cam rotatable about a rotation axis bidirectionally in a normal direction and a reverse direction, the cam including:

a phase-detector wall extending in a circumferential direction centered at the rotation axis of the cam, the phase-detector wall having:

a first slit having a first width in the circumferential direction, the first slit being configured to be detected by the detector when the developing roller is at the separated position, and a second slit having a second width in the circumferential direction, the second width differing from the first width, the second slit being configured to be detected by the detector when the developing roller is at the contacting position; and a controller, wherein, when the cover moves from the open position to the closed position, the controller is configured to:

control the cam to start rotating in the reverse direction;

after causing the cam to rotate in the reverse direction, and after the first slit is detected by the detector, control the cam to stop rotating;

after causing the cam to stop rotating in the reverse direction, control the cam to rotate in the normal direction; and after causing the cam to rotate in the normal direction, control the cam to stop rotating at a position where the first slit is detected by the detector.

11. The image forming apparatus according to claim 10, wherein the controller is configured to, when the image forming apparatus forms an image on a sheet, for maintaining the developing roller at the contacting position, cause the cam to stop in a phase, in which the second slit is detected by the detector.

12. The image forming apparatus according to claim 10, wherein the second width is greater than the first width.

13. An image forming apparatus, comprising:

a casing having an opening;

a cover movable between a closed position, where the cover covers the opening, and an open position, where the cover does not cover the opening;

a photosensitive drum;

a developing roller;

a moving mechanism configured to move the developing roller between a contacting position, at which the developing roller contacts the photosensitive drum, and a separated position, at which the developing roller is separated from the photosensitive drum, the moving mechanism comprising:

a cam configured to rotate about a rotation axis bidirectionally in a normal direction and a reverse direction, the cam including:

a phase-detector wall extending in a circumferential direction centered at the rotation axis of the cam, the phase-detector wall having:

a first slit; and a second slit having a different size in the circumferential direction from the first slit;

a photo-interrupter including a light-emitter and a light-receiver; and a controller configured to:

when the cover moves from the open position to the closed position, start rotating the cam in the reverse direction;

after starting rotating the cam in the reverse direction, detect the first slit based on a time period, in which light emitted from the light-emitter passes through one of the first slit and the second slit; and after detecting the first slit, stop rotating the cam.

* * * * *